US006640767B2

(12) United States Patent
Kato et al.

(10) Patent No.: US 6,640,767 B2
(45) Date of Patent: Nov. 4, 2003

(54) OIL PAN STRUCTURE AND OIL PAN SEPARATOR

(75) Inventors: Zenichiro Kato, Mishima (JP); Shoji Miyazaki, Susono (JP); Shinzaburo Ichiman, Okayama (JP); Hiroaki Akita, Gotenba (JP); Toshiteru Ando, Ogaki (JP); Tsutomu Okuda, Ogaki (JP)

(73) Assignees: Toyota Jidosha Kabushiki Kaisha, Toyota (JP); Pacific Industrial Co., Ltd., Ogaki (JP); Uchiyama Manufacturing Corp., Okayama (JP); U-Sun Gasket Corporation, Shizuoka (JP)

( * ) Notice: Subject to any disclaimer, the term of this patent is extended or adjusted under 35 U.S.C. 154(b) by 0 days.

(21) Appl. No.: 10/197,807

(22) Filed: Jul. 19, 2002

(65) Prior Publication Data

US 2003/0029412 A1 Feb. 13, 2003

(30) Foreign Application Priority Data

| | | |
|---|---|---|
| Jul. 25, 2001 | (JP) | 2001-223755 |
| Nov. 21, 2001 | (JP) | 2001-356672 |
| May 20, 2002 | (JP) | 2002-145291 |

(51) Int. Cl.[7] ..... F01M 1/00

(52) U.S. Cl. ..... 123/195 C; 123/196 R

(58) Field of Search ..... 123/195 C, 196 R; 184/6.5, 6.8, 6.13

(56) References Cited

U.S. PATENT DOCUMENTS

| | | | | |
|---|---|---|---|---|
| 4,505,352 A | * | 3/1985 | Onda et al. | 180/219 |
| 4,674,457 A | * | 6/1987 | Berger et al. | 123/196 R |
| 4,920,930 A | * | 5/1990 | Sakano et al. | 123/41.86 |
| 6,308,679 B1 | * | 10/2001 | Nakamura et al. | 123/195 R |
| 6,530,356 B2 | * | 3/2003 | Inoue et al. | 123/196 R |

FOREIGN PATENT DOCUMENTS

| | | |
|---|---|---|
| JP | U 61-134509 | 8/1986 |
| JP | A 6-17633 | 1/1994 |
| JP | A 6-346717 | 12/1994 |
| JP | A 10-71837 | 3/1998 |

* cited by examiner

*Primary Examiner*—Willis R. Wolfe
*Assistant Examiner*—Douglas A. Salser
(74) *Attorney, Agent, or Firm*—Oliff & Berridge, PLC

(57) ABSTRACT

The oil pan structure of the present invention comprises an oil pan separator 3, disposed within an oil pan 2, for separating a main chamber provided with a suction port disposed therewithin and a sub chamber provided with no suction port from each other, the oil pan separator 3 having a recess forming the main chamber, the main chamber communicating with the inside of an engine block 1, the recess being formed with communication holes 3*c*, 3*d* for communicating the main and sub chambers to each other. The sub chamber is formed so as to surround the main chamber as a whole, whereas the outer face of the bottom part of the oil pan separator 3 and the inner face of the bottom part of the oil pan 2 are not in contact with each other. Therefore, raising the temperature of engine oil within the main chamber earlier can lubricate the engine more effectively.

19 Claims, 19 Drawing Sheets

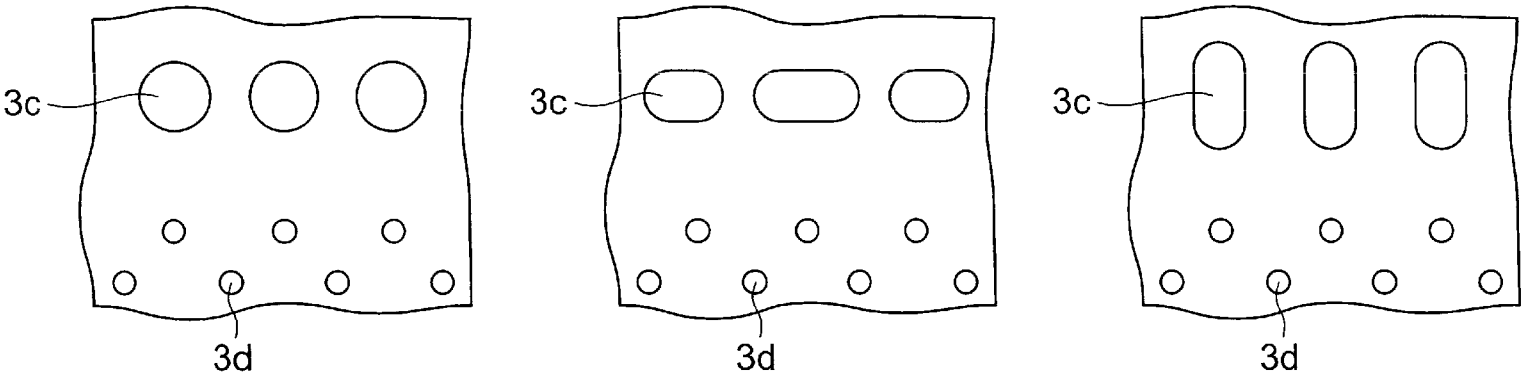
Fig.9A
Fig.9B
Fig.9C
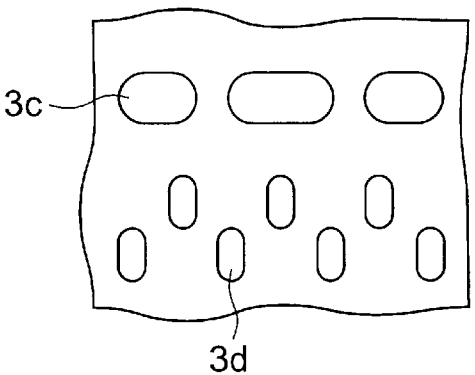
Fig.9D
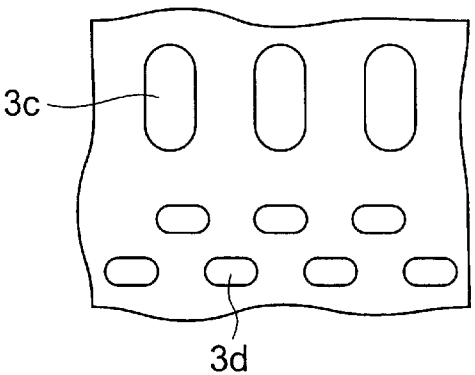
Fig.9E

OIL PAN STRUCTURE AND OIL PAN SEPARATOR

BACKGROUND OF THE INVENTION

1. Field of the Invention

The present invention relates to a structure of an oil pan for storing an engine oil; and an oil pan separator, disposed within the oil pan, for separating the inside of the oil pan into main and sub chambers.

2. Related Background Art

Engine oils have conventionally been employed for lubricating/cooling engines. Such an engine oil is stored in an oil pan disposed under an engine, and is circulated through individual parts of the engine by an oil pump. The engine oil circulated through the individual parts of the engine drops into the oil pan thereunder. The engine oil dropped into the oil pan is recirculated through the individual parts of the engine by the oil pump. During this period, the engine oil receives heat from the individual parts of the engine and cools them. The engine oil also acts to form oil films in the individual parts of the engine, thereby promoting lubrications among the parts, preventing the parts from oxidizing, and so forth.

Immediately after a cold start, the engine oil stored in the oil pan is cold and has a high viscosity, whereby it is not in a state suitable for circulating through the individual parts of the engine and lubricating them. Therefore, immediately after the cold start, the engine oil is desired to raise its temperature as soon as possible, so as to attain a state having an appropriate viscosity. To this aim, it has already been proposed to divide an oil pan into a plurality of sections, so as to prepare a state where the engine oil within one of the sections is likely to circulate immediately after the cold start, and heat the engine oil within this section earlier so as to attain a favorable state (e.g., Japanese Patent Application Laid-Open No. HEI 6-17633).

However, there have been demands for improvements by which the temperature of engine oil rises earlier. An early temperature rise in the engine oil also contributes to ameliorating the fuel consumption by lowering frictions earlier, thus being desired for improvement in view of strong demands for amelioration of fuel consumption in recent years as well. Also, improvements in terms of manufacture have been desired in conventional methods in which, for example, metal sheets are welded to the inside of the oil pan in order to divide it into a plurality of sections.

Therefore, it is an object of the present invention to provide an oil pan structure which can raise the temperature of an engine oil more effectively, and an oil pan separator which can suitably be used in this structure.

SUMMARY OF THE INVENTION

The oil pan structure of the present invention comprises an oil pan separator, disposed within an oil pan, for separating a main chamber provided with a suction port disposed therewithin and a sub chamber provided with no suction port from each other, the oil pan separator having a recess forming the main chamber, the main chamber communicating with the inside of an engine block, the recess being formed with a communication hole for communicating the main and sub chambers to each other. This enables the engine oil within the main chamber to raise its temperature earlier so as to be sent to individual parts of the engine, whereby optimal lubrications can be achieved in the individual parts of the engine at an early stage. As a result, earlier stabilization of engine operations, improvement in exhaust cleaning performances, amelioration in fuel consumption performances, and the like can be achieved.

Preferably, the sub chamber is formed so as to surround the main chamber as a whole, whereas the outer face of a bottom part of the oil pan separator and the inner face of a bottom part of the oil pan are not in contact with each other. Here, it is also preferred that a damping material be disposed between the bottom part of the oil pan separator and the oil pan. Here, it will also be preferred if an outer periphery of the oil pan separator is secured by being held between divided parts of the engine block or between the engine block and the oil pan.

Preferably, the oil pan has a foamed resin layer on the inner surface side thereof, whereas the foamed resin layer has a higher density in a surface coming into contact with an oil and a lower density on the inside thereof. Here, it is also preferred that the oil pan separator be formed from a synthetic resin. Here, it will also be preferred if the oil pan separator is formed from a foamed resin having a higher density in each surface coming into contact with the oil and a lower density on the inside thereof.

Preferably, an oil suction pipe having the suction port at an end part thereof is integrally formed with the oil pan separator. Here, it is also preferred that the recess of the oil pan separator have a double-wall structure.

It is preferred that a lid be disposed on the upper side of the main chamber, an opening for introducing an engine oil into the main chamber being formed in the lid at a center thereof, the lid tilting downward in an outward direction from the opening.

Preferably, at least one first communication hole is formed on the upper side of a side wall of the main chamber, at least one second communication hole is formed on the lower side of the side wall of the main chamber, each first communication hole has an opening area larger than that of each second communication hole, and the first and second communication holes are formed at respective positions substantially opposing each other with respect to the center of the main chamber. It will be preferred if such a communication hole for communicating the main and sub chambers to each other is a burring hole or a louver hole.

Preferably, the oil pan structure comprises a heat exchanger for exchanging heat between engine cooling water and the engine oil, a heat storage tank for storing the engine cooling water after warming up, and heat-accumulated water supplying means for supplying the heat exchanger with the engine cooling water stored in the heat storage tank immediately after a cold start. Alternatively, it is preferred that the oil pan structure comprise a heat storage tank for storing the engine tank after warming up, and heat-accumulated oil supplying means for supplying the main chamber with the engine oil stored in the heat storage tank immediately after a cold start.

The oil pan separator of the present invention is disposed in an oil pan of an internal combustion engine, and separates a space within the oil pan into a main chamber provided with a suction part (suction port) of an oil pump and a sub chamber provided with no suction part. Here, the oil pan separator has a main chamber constructing part (recess) formed from a heat-insulating sheet material having a heat-insulating property and recessed so as to be able to store a lubrication oil, whereas the main chamber constructing part is accommodated in the oil pan. A space within the main chamber constructing part constitutes the main chamber, whereas a portion of the part constituting a wall of the main chamber constructing part separates the main and sub chambers from each other.

Preferably, the oil pan separator is integrally formed with an oil pan gasket part interposed between a cylinder block of the internal combustion engine and the oil pan. Preferably, the heat-insulating sheet material is one in which both sides of a metal sheet are coated with a compound containing a heat-resistant nonmetal fiber other than asbestos, a filler, and an elastomer. Preferably, a portion separating the main and sub chambers from each other in the part constituting the wall of the main chamber constructing part is formed with an opening (communication hole) communicating the main and sub chambers to each other, whereas a nonwoven or net adapted to filter a lubrication oil therethrough is attached to the opening.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIGS. 9A to 9E are explanatory views showing variations of communication holes;

DESCRIPTION OF THE PREFERRED EMBODIMENTS

In the following, embodiments of the oil pan structure (and oil pan separator) in accordance with the present invention will be explained. FIGS. 1 to 6 show the oil pan part of the first embodiment.

Figure 4:
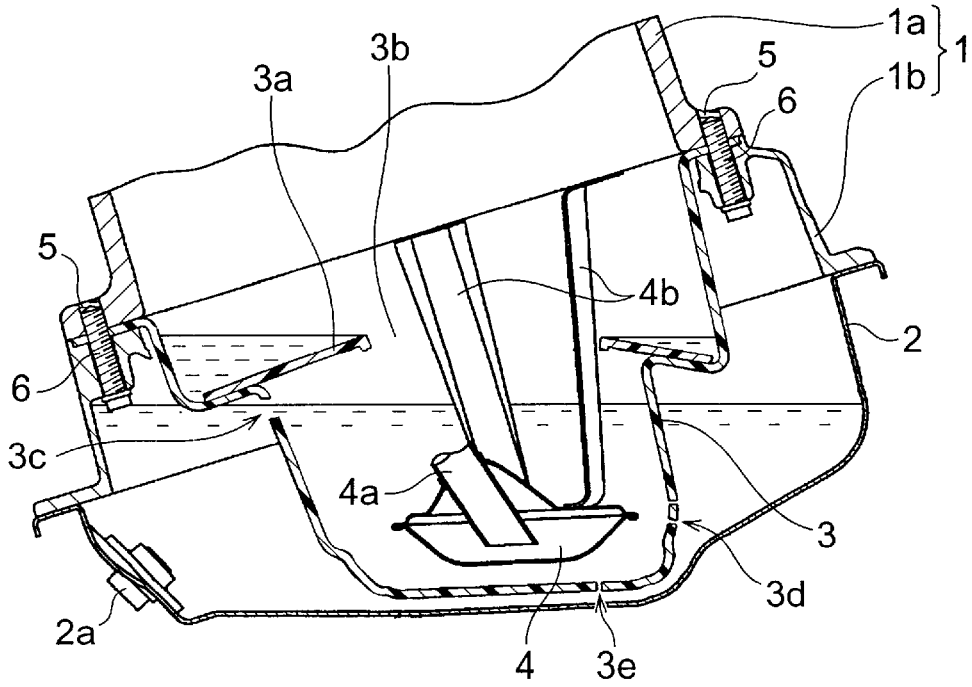
FIG. 4 is a sectional view taken along the line IV—IV in FIG. 1.
Figure 5:
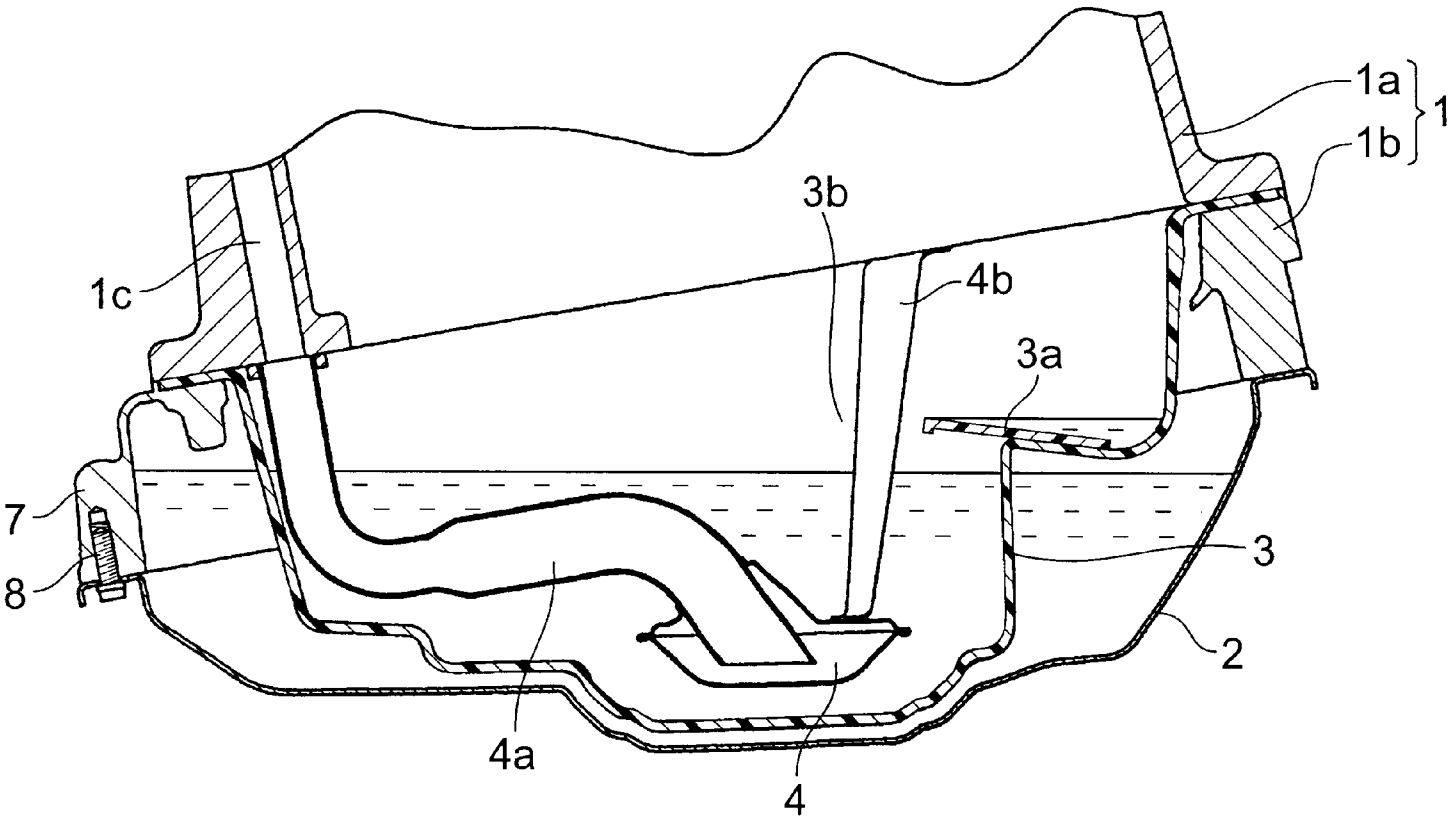
FIG. 5 is a sectional view taken along the line V—V in FIG. 1.
Figure 6:
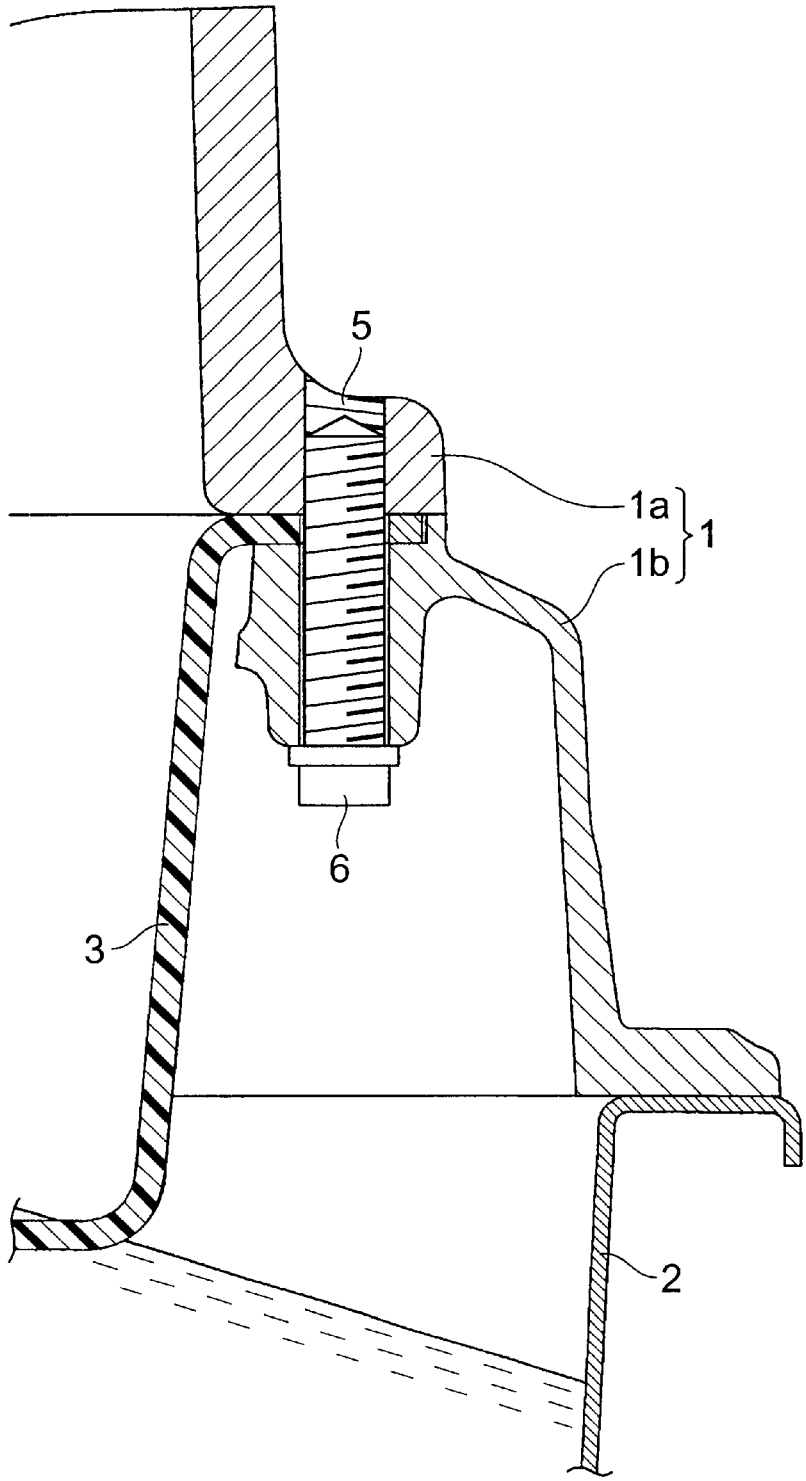
FIG. 6 is an enlarged sectional view showing a state where a peripheral part of an oil pan separator is secured.

These drawings mainly show a lower case 1*b* constituting the lower part of an engine block 1; an oil pan 2; and an oil pan separator 3, disposed within the oil pan 2, separating the inside of the oil pan 2 into two sections (main and sub chambers). As illustrated in FIGS. 4 to 6, the upper part of the lower case 1*b* is connected to a cylinder block 1*a*. The cylinder block 1*a*, the lower case 1*b*, and the like constitute the engine block 1.

Figure 7:
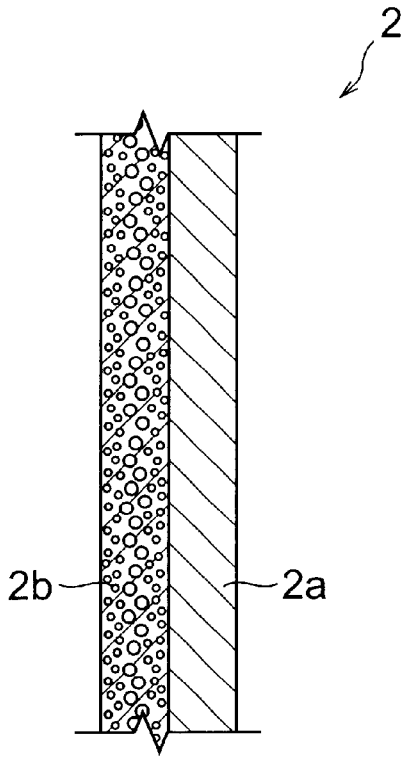
FIG. 7 is an enlarged sectional view of a part of an oil pan.

The engine block 1 (cylinder block 1*a* and lower case 1*b*) have substantially the same material and structure as those conventionally used. The oil pan 2 has a multilayer structure composed of a foamed resin layer and a metal layer as shown in the enlarged sectional view of FIG. 7 here, though one made of a metal (steel sheet), which has conventionally been used in general, may be employed as well. The right and left sides of FIG. 7 refer to the outer and inner sides of the oil pan 2, respectively. The outermost part of the oil pan 2 is a metal panel 2*a* which has been pressed as in conventional oil pans. Its inner surface side directly coming into contact with an engine oil is formed with a foamed resin layer 2*b*.

As the foamed resin layer 2*b*, one preformed in conformity to the inner form of the metal panel 2*a* may be secured to the inner face of the metal panel 2*a* by bonding or the like, or it may directly be formed on the inner face of the metal panel 2*a*. The foamed resin layer 2*b* has a higher density on the surface side directly coming into contact with the oil, and a lower density on the inner side thereof. This can restrain the oil from infiltrating into the foamed resin layer 2*b*.

The foamed resin layer 2*b* exhibits excellent heat-insulating and sound-absorbing properties, since it is a resin and has numerous bubbles therewithin. Therefore, forming the inner face of the oil pan 2 with such a foamed resin layer 2*b* can restrain the oil pan 2 from releasing heat to the outside, whereby the oil can effectively raise its temperature at an early stage. Also, since it is excellent in the sound-absorbing property, the transmission of sounds from the inside of the oil pan to the outside can be suppressed.

Though the foamed resin layer 2*b* has a higher density on the metal panel 2*a* side as well in this embodiment, it is not always necessary to do so. It will be sufficient if the structure is such that at least the surface directly coming into contact with the oil has a higher density whereas the inner side thereof has a lower density. For example, the structure may comprise a higher density part of the foamed resin layer 2*b*, a lower density part, and the metal panel 2*a* successively from the inner face side of the oil pan 2.

A strainer 4 acting as a suction port (suction part) for inhaling the engine oil stored in the oil pan 2 is disposed within the oil pan 2. The strainer 4 has an oil suction pipe 4*a*, which communicates with an oil flow path 1*c* within the engine block 1 as shown in FIG. 5. An oil pump is located beyond the oil flow path 1*c*. The strainer 4 is secured to the cylinder block 1*a* by way of the oil suction pipe 4*a* and a stay 4*b*. If the strainer 4 is made of a resin instead of a metal, it can restrain heat from escaping through the strainer 4, which further contributes to raising the oil temperature at an early stage.

A front end part of the strainer is positioned within the oil pan separator 3, which will be explained later. The part of oil pan separator 3 where the strainer 4 is disposed is formed like a recess. The inside of the oil pan 2 is separated by the oil pan separator 3 into two sections, in which the section provided with the front end of the strainer 4 (the inner side of the oil pan separator 3) will be referred to as a main chamber, whereas the section not provided with the front end of the strainer 4 (the outer side of the oil pan separator 3) will be referred to as a sub chamber. The respective volumes of the main and sub chambers are set to 2 liters and 1.6 liters, for example, though they can be determined as appropriate. In FIG. 4, the oil suction pipe 4*a* is partly omitted for convenience of viewing.

Here, the sub chamber is disposed so as to surround the whole main chamber. The outer face of the bottom part of the oil pan separator 3 (=the outer face of the main chamber) and the inner face of the bottom part of the oil pan 2 are not in contact with each other. Therefore, the heat of the engine oil within the main chamber is hard to escape to the oil pan 2 itself or the air outside the oil pan 2. The engine is often mounted in a vehicle or the like in a somewhat tilted fashion. FIGS. 4 and 5 are illustrated with the tilt corresponding to that in the state mounted in the vehicle, whereby the engine oil surface within the oil pan 2 is oriented substantially horizontal. The oil pan separator 3 is a member having a heat-insulating property in the example of FIGS. 4 to 6, with its main constituent part being made of a synthetic resin (foamed resin) in this embodiment. Though it is made of a foamed resin in this embodiment, it maybe made of a metal (steel sheet), coatings and other members may be attached to its surface (rear face), and other members may be inserted therewithin as well.

Figure 8:
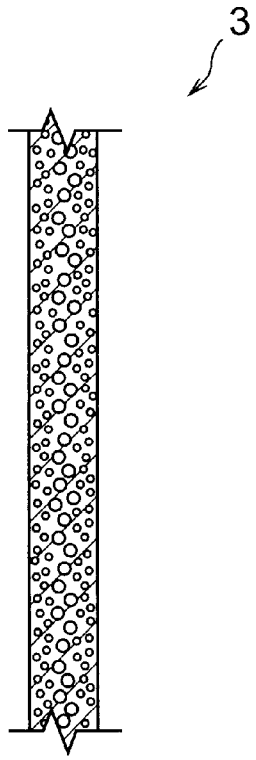
FIG. 8 is an enlarged sectional view of a part of the oil pan separator.
Figure 10A:
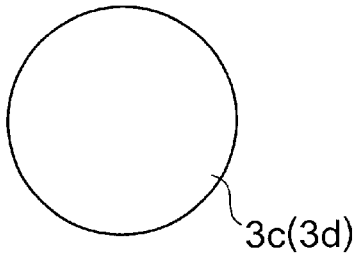
FIG. 10A is a front view showing the hole form in a first example of communication hole.
Figure 10B:
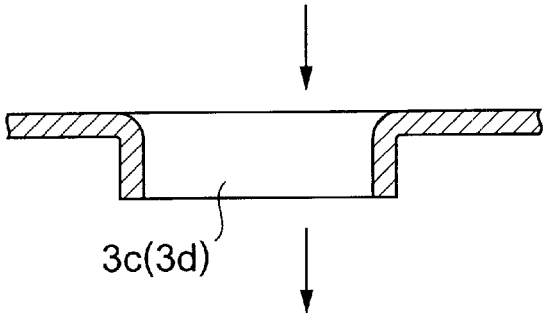
FIG. 10B is a sectional view of the hole shown in FIG. 10A.
Figure 11A:
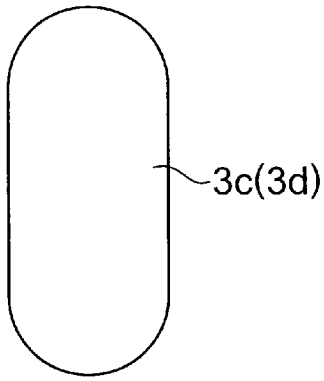
FIG. 11A is a front view showing the hole form in a second example of communication hole.
Figure 11B:
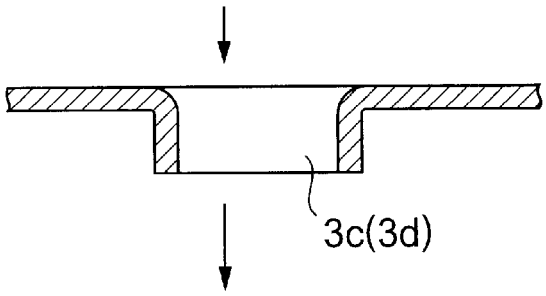
FIG. 11B is a sectional view of the hole shown in FIG. 11A.
Figure 12A:
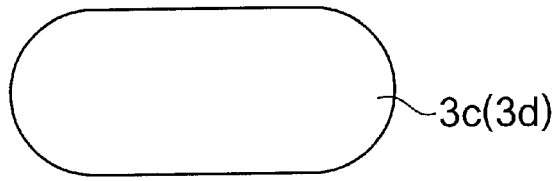
FIG. 12A is a front view showing the hole form in a third example of communication hole.
Figure 12B:
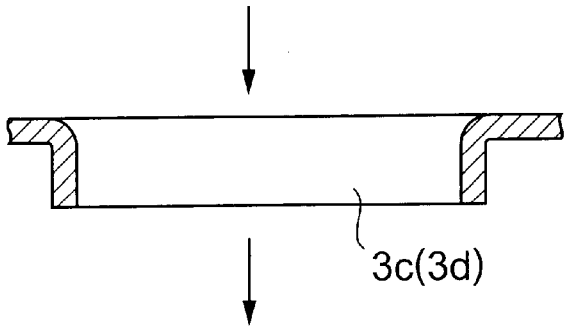
FIG. 12B is a sectional view of the hole shown in FIG. 12A.

FIG. 8 shows a sectional view of a part of the oil pan separator 3 formed from a foamed resin. The oil pan separator 3 has a higher density on the surface side directly coming into contact with the oil and a lower density on the inner side thereof. This can restrain the oil from infiltrating into the foamed resin. If the oil infiltrates into the oil pan separator 3, the oil will directly travel between the inside and outside of the oil pan separator 3, thereby inhibiting the oil within the oil pan separator 3 from raising its temperature at an early stage.

The oil pan separator 3 is formed from a resin having numerous bubbles therewithin (in the lower density part in particular), thus exhibiting excellent heat-insulating/sound-absorbing properties as with the foamed resin layer 2*b* of the oil pan 2 mentioned above. Therefore, the oil pan separator 3 can restrain heat from being released from the inside thereof to the outside, thereby effectively raising the temperature of the oil within the oil pan separator 3 at an early stage. Also, since the oil pan separator 3 is excellent in the sound-absorbing property, it can restrain sounds from being transmitted from the inside of the oil pan to the outside.

When the oil within the oil pan separator 3 raises its temperature at an early stage, a difference in viscosity occurs between the inside and outside of the oil pan separator 3. This oil viscosity difference attenuates sounds from the inside of the oil pan 2 (oil pan separator 3) to the outside, thereby achieving a sound-absorbing effect. Since the noise generated by the engine is relatively large until a warm-up thereof is completed, the sound-absorbing effect caused by the viscosity difference is effective at the time immediately after a cold start and the like.

Though the oil pan separator 3 has a configuration of higher density part/lower density part/higher density part in this embodiment, it will be sufficient if it has at least such a structure that a surface directly coming into contact with the oil has a higher density and the inner side thereof has a lower density. For example, it may have a configuration of higher density part/lower density part/insert/lower density part/higher density part or a configuration of higher density part/lower density part/higher density part/insert/higher density part/lower density part/higher density part successively from the inner face side of the oil pan separator 3.

The whole periphery of the oil pan separator 3 is held between the cylinder block 1*a* and the lower case 1*b* as shown in FIGS. 4 and 6, whereby the oil pan separator 3 is secured within the oil pan 2. The connecting part between the cylinder block 1*a* and the lower case 1*b* is formed with bolt joints 5 at predetermined intervals (see FIG. 1), at which the periphery of the oil pan separator 3 is fastened together with bolts 6. On the other hand, the connecting part between the lower case 1*b* and the oil pan 2 is formed with bolt joints 7 at predetermined intervals (see FIG. 1), at which the lower case 1*b* and the oil pan 2 are connected together with bolts 8 as shown in FIG. 5.

Here, the outer periphery of the oil pan separator 3 also functions as a gasket. Coating both sides of the fastened part of the oil pan separator 3 with a member having a sealing effect can improve the sealing effect. Employable as the coating material is a compound containing a heat-resistant metal fiber, a filler, and an elastomer, and the like. In such a case, the seal surface can be set to a uniform surface pressure, so that the synthetic resin constituting the oil pan separator 3 can be prevented from flowing out due to the heat at the bolt fastening part, whereby the oil can reliably be prevented from leaking.

The above-mentioned recess is formed in the oil pan separator 3 substantially at the center thereof, and the front end part of the strainer 4 is disposed therein. A lid 3*a* is formed above the recess so as to cover the latter. In this embodiment, the body of oil pan separator 3 is integrally formed from a synthetic resin, and the lid 3*a* is secured to the body by melting and the like. When the oil pan separator 3 is constituted by a metal or the like, the lid 3*a* may be attached thereto by spot welding and the like.

At the center of the lid 3*a*, an opening 3*b* for introducing the engine oil stored on the upper face of the lid 3*a* into the recess is formed. The lid 3*a* tilts downward in the outward direction from the opening 3*b*. Namely, the opening 3*b* of the lid 3*a* is positioned higher. Since such a tilt is formed, the engine oil dropping from the upper side is likely to stay on the upper face of the lid 3*a*. The lid 3*a* also acts as a baffle plate for restraining the engine oil within the main chamber from moving to the upper side and preventing the strainer 4 from inhaling air. The upward movement of engine oil is likely to occur at the time of abrupt braking, sudden turning, and the like.

Figure 1:
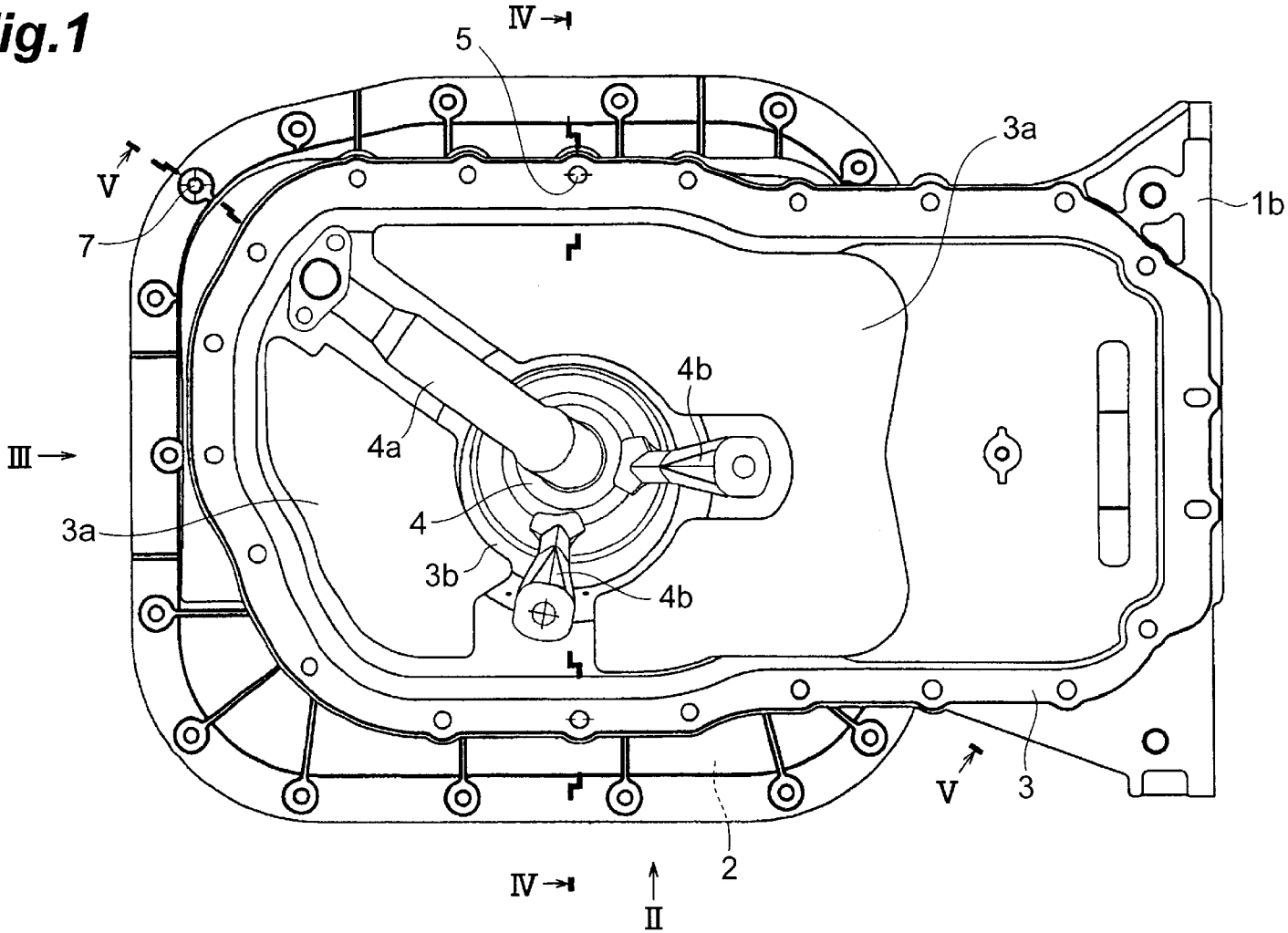
FIG. 1 is a plan view showing the configuration of a lower part of an engine having an oil pan structure of the present invention.
Figure 2:
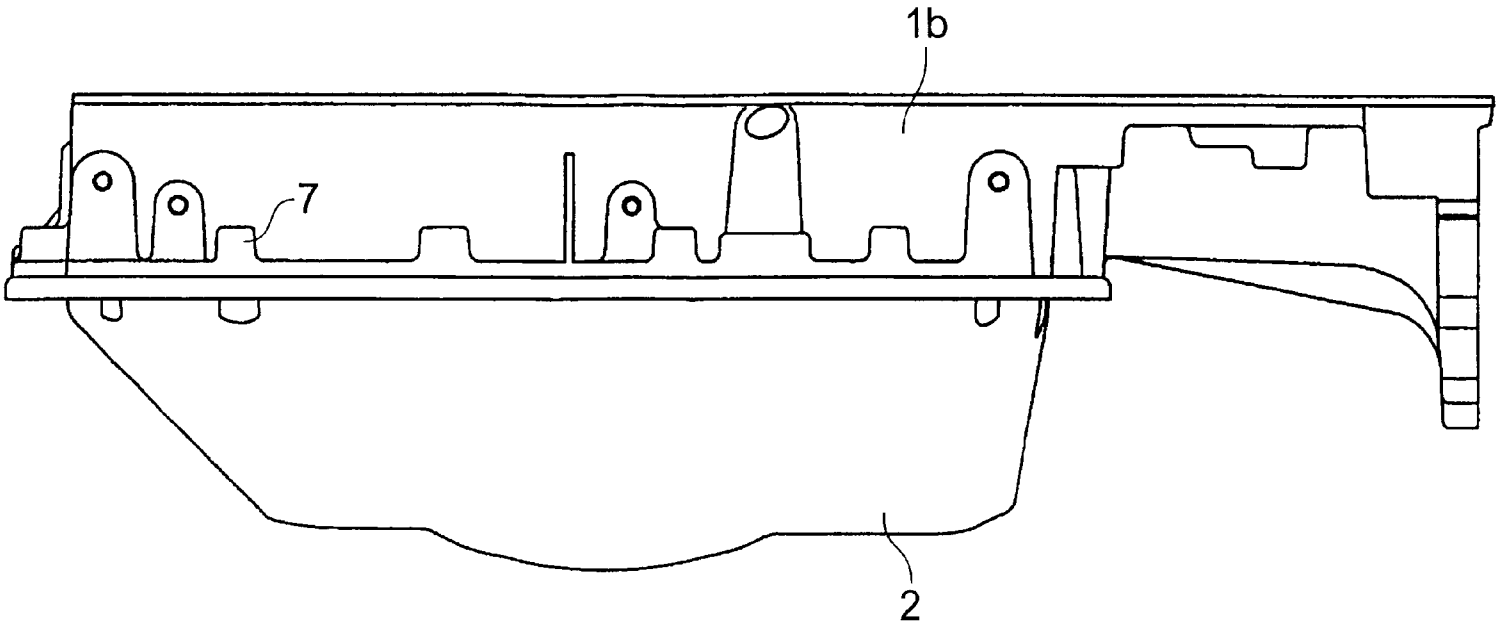
FIG. 2 is a front view as seen from the direction of arrow II in FIG. 1.
Figure 3:
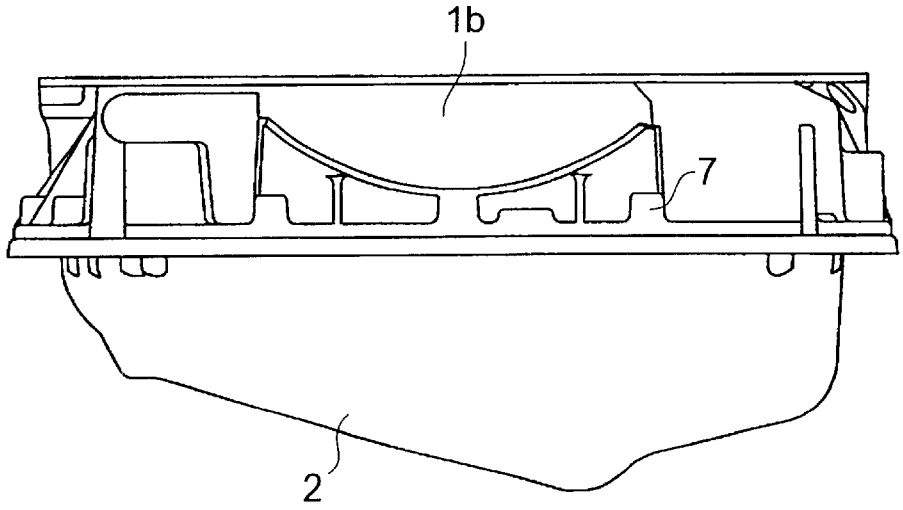
FIG. 3 is a side view as seen from the direction of arrow III in FIG. 1.

FIGS. 4 and 5 illustrate the state where all the engine oil within the engine has returned to the inside of the oil pan 2 (when the engine is not operating). Even when the engine is not operating (during halts), the engine oil within the oil pan separator 3 is kept warm by the lid 3*a* and the engine oil stored in the upper face part thereof. In this embodiment, as shown in FIG. 1, the opening 3*b* is expanded outward in the part above the oil suction pipe 4*a* of the strainer 4 and at the part of the stay 4*b* thereof. Though the engine oil is likely to drop downward from these parts, the lid 3*a* still makes it easier for the engine oil to stay on the upper face thereof.

A side wall part of the recess is formed with communication holes for letting the oil travel between the main chamber on the inner side of the oil pan separator 3 and the sub chamber on the outer side thereof. Here, first communication holes 3*c* having a larger size are formed on the upper side, whereas second communication holes 3*d* having a smaller size are formed on the lower side. For example, several first communication holes 3*c* each having a diameter of 8 mm, and ten-odd to several ten second communication holes 3*d* each having a diameter of 2 mm are formed. The first communication holes 3*c* and the second communication holes 3*d* are disposed at respective positions substantially opposing each other with respect to the center of the main chamber. As long as the engine oil within the sub chamber has a high viscosity, only the engine oil within the main chamber is used for circulation. When the viscosity of the engine oil within the sub chamber decreases, the engine oil is introduced from the second communication holes 3*d* into the main chamber. Namely, the communication of engine oil between the main and sub chambers is controlled by use of the change in viscosity of engine oil.

This is based on the fact that the first communication holes 3*c* have a larger opening diameter and a lower resistance, and that the engine oil on the upper side has a higher temperature and a lower viscosity within the sub chamber. As a result, when introducing the engine oil from the sub chamber to the main chamber, the engine oil exhibiting a higher temperature and a lower viscosity is supplied. When the amount of engine oil returning to the main chamber is large while the engine oil within the sub chamber has a low temperature and a high viscosity, the recirculation of engine oil within the main chamber is carried out in preference to the introduction of engine oil from the sub chamber to the main chamber.

The temperature of engine oil within the sub chamber rises gradually, whereby the amount of exchange of engine oil between the main and sub chambers gradually increases so that the amount of engine oil in the main chamber and that in the sub chamber eventually equal each other. When the main and sub chambers are separated from each other as such, however, the temperature of engine oil on the main chamber side can be raised earlier, and the engine oil thus heated earlier can preferentially be circulated through individual parts of the engine. Constructing the oil pan separator 3 from a material excellent in heat insulation (e.g., foamed resin shown in FIG. 8) is also effective in raising the temperature of engine oil within the main chamber at an early stage.

The first communication holes 3*c* and second communication holes 3*d* are disposed at respective positions substantially opposing each other with respect to the center of the main chamber because of the following reason. Though the temperature within the oil pan separator 3 is raised earlier as long as the oil temperature is not so high, the temperature of oil within the sub chamber is raised after the oil within the main chamber is sufficiently warmed. Here, as mentioned above, the warmed oil is likely to flow into the sub chamber from the main chamber by way of the first communication holes 3*c* formed on the upper side. Though the oil within the sub chamber is warmed with the warm oil, the temperature of oil within the sub chamber will be hard to rise if the warm oil is immediately refluxed into the main chamber.

Therefore, the oil having flown into the sub chamber from the main chamber by way of the first communication holes 3*c* is sufficiently circulated through the sub chamber and then is refluxed into the main chamber by way of the second communication holes 3*d*, whereby the temperature rise within the sub chamber is promoted. In this case, arranging the first communication holes 3*c* and second communication holes 3*d* at respective positions substantially opposing each other with respect to the center of the main chamber makes it easier for the oil to circulate sufficiently. Since the second communication holes 3*d* are made smaller, the oil flow from the sub chamber to the main chamber does not occur sufficiently until the oil temperature near the second communication holes 3*d* within the sub chamber rises to such an extent that the viscosity decreases. This is also effective in increasing the temperature of oil within the sub chamber after the temperature of oil within the main chamber is raised enough.

FIGS. 9A to 9E show examples of forms of the first communication holes 3*c* and second communication holes 3*d*. For convenience of viewing, the first communication holes 3*c* and second communication holes 3*d* are depicted closer to each other in FIGS. 9A to 9E than in practice. Each of the first communication holes 3*c* and second communication holes 3*d* may have not only a simple circular form but also a horizontally or vertically elongated form. The flow of engine oil can be regulated by the position and size of communication holes formed in the oil pan separator 3 as such. In practice, since various kinds of engine oils with their viscosity ranging from high to low are employed, an attachment system may be used for freely changing the number, size, and thickness of the first communication holes 3*c* and second communication holes 3*d* in order to optimize the communication control depending on the viscosity of engine oil.

Figure 13A:
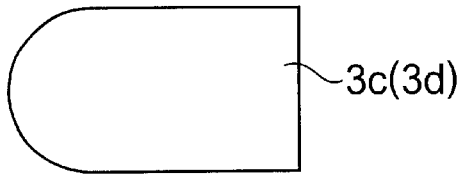
FIG. 13A is a front view showing the hole form in a fourth example of communication hole.
Figure 13B:
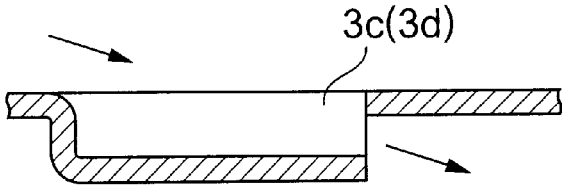
FIG. 13B is a sectional view of the hole shown in FIG. 13A.

When the oil pan separator 3 is made of a metal (steel sheet), it is effective for the first communication holes 3*c* and second communication holes 3*d* to be formed into burring holes such as those shown in FIGS. 10A, 10B, 12A, and 12B or louver holes such as that shown in FIGS. 13A and 13B in order to control the flow of engine oil between the main and sub chambers mentioned above. Each burring hole has a rim formed with a rib. Each louver hole has a slit which opens substantially perpendicular to the sheet material. The engine oil is likely to travel in the direction indicated by each of the arrows in FIGS. 10A, 10B to FIGS. 13A, 13B, but hard to travel in the opposite direction. This can control the flow of engine oil.

Forming these holes can increase the rigidity of the oil pan separator 3, thus making it possible to suppress the vibration/noise of the oil pan separator 3. Making the rib of a burring hole higher can restrain the engine oil from moving on the side to which the burring hole projects. If the burring hole projects to the inside of the main chamber, for example, the burring hole will restrain the engine oil from moving upward along the inner wall of the oil pan separator 3, whereby the strainer 4 can be prevented from inhaling air.

Further, a drain hole 3*e* is formed at the lowest location of the bottom part in the oil pan separator 3. The drain hole 3*e* is used for discharging the engine oil from within the main chamber to the sub chamber side when removing the engine oil from within the oil pan 2. A drain bolt 2*a* for removing the oil is attached to the oil pan 2. If the drain hole 3*e* is an outwardly projecting burring hole, it can promote the discharging of engine oil from the main chamber when discarding the oil. Using the burring holes can also suppress the movement of engine oil upon abrupt starts or sudden stops, so as to prevent the strainer 4 from inhaling air, and enhance the rigidity so as to suppress vibration and noise.

In the case of the oil pan structure with the configuration mentioned above, immediately after a cold start, the strainer 4 initially inhales the engine oil from the main chamber within the oil pan separator 3, and thus inhaled engine oil is supplied to individual parts of the engine. The engine oil warmed after circulating through the individual parts of the engine drops onto the upper face of the lid 3*a* of the oil pan separator 3 from thereabove. The warmed engine oil at the highest temperature stays on the lid 3*a* due to the above-mentioned tilt of the lid 3*a*, thereby forming a cover exhibiting a high temperature above the main chamber. As a result, the warmed engine oil within the main chamber becomes effective in keeping the temperature of engine oil thereunder within the main chamber.

The engine oil on the lid 3*a* successively flows down as the upper face of the lid 3*a* is filled therewith. Namely, the engine oil having received heat from the individual parts of the engine is preferentially collected into the main chamber, whereby the temperature of engine oil within the is main chamber is initially raised at an early stage. Since the suction port of the strainer 4 is disposed within the main chamber, the engine oil having raised its temperature earlier within the main chamber is preferentially circulated through the individual parts of the engine. Then, as the temperature of engine oil within the main chamber increases, the temperature of engine oil within the sub chamber is gradually raised due to the thermal conduction and the exchange of engine oil between the main and sub chambers.

For a while after the cold start of the engine, since the temperature of engine oil within the main chamber is raised earlier, the temperature of engine oil within the sub chamber is initially lower than that of the engine oil within the main chamber. As a consequence, for a while after the cold start of the engine, the viscosity of engine oil within the sub chamber tends to be higher, whereby the engine oil is hard to move from the sub chamber to the main chamber. Therefore, the temperature of engine oil within the main chamber is raised further earlier.

In this embodiment, the oil pan separator 3 is made of a synthetic resin excellent in heat insulation, so as to restrain the heat of engine oil within the main chamber from being lost, whereby the temperature of engine oil within the main chamber is raised earlier. Though a synthetic resin is used as a material excellent in heat insulation for the oil pan separator 3 in this embodiment, porous aluminum (including alloys mainly composed of aluminum) may be used as well.

In this embodiment, the sub chamber is formed so as to surround the whole main chamber. Since the sub chamber exists, the heat within the main chamber is hard to escape to the outside (outer air), whereby the temperature of engine oil in the main chamber is raised further earlier. Since the oil pan separator 3 and the oil pan 2 are not in contact with each other, the heat is not taken by the oil pan 2 due to thermal conduction. Though there is heat escaping from the main chamber to the sub chamber, it is used for raising the temperature of engine oil within the sub chamber and thus is not wasted. Though the temperature of engine oil within the main chamber and that within the sub chamber finally become substantially equal to each other, the engine oil heated to an appropriate temperature earlier can be sent to individual parts of the engine immediately after the cold start. Hence, the engine can be operated in a stable state earlier.

Also, frictions can be reduced earlier, which is effective in ameliorating the fuel consumption. Further, since the inside of the oil pan 2 is divided by use of the oil pan separator 3, it will be sufficient if the oil pan 2 is replaced alone at the time of changing the oil pan 2 (which may break upon bumping against a road shoulder). The oil pan 2 itself has a normal form, which does not become expensive. Though forms of individual parts are required to be taken into consideration when constructing the structure mentioned above, it will be sufficient if the oil pan separator 3 is added to conventional components, which does not complicate the structure of engine.

Some modified examples of the above-mentioned first embodiment will now be explained. In the following modified examples, constituent parts identical or equivalent to those in the above-mentioned first embodiment will be referred to with numerals identical to each other without repeating their detailed explanations. Here, the configuration of the above-mentioned first embodiment and the following modified examples can be used in any combination as appropriate. For example, though the example shown in FIG. 15, which will be explained later, does not have a member corresponding to the lid 3*a* of the first embodiment, such a lid 3*a* may be combined therewith.

Figure 14:
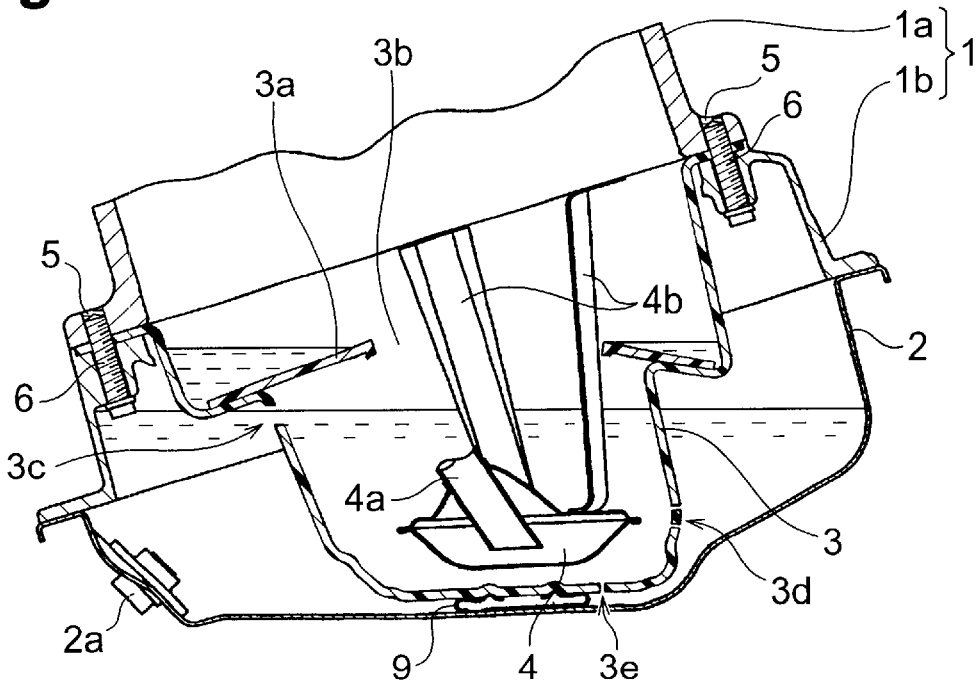
FIG. 14 is a view, similar to FIG. 4, showing a first modified example of the oil pan structure of the present invention.

In the modified example shown in FIG. 14, a damping material 9 is disposed between the oil pan separator 3 and the oil pan 2. FIG. 14 is a view corresponding to FIG. 4 showing the first embodiment. The damping material 9 in this example, which is a metal spring material having a resilient restoring force, is attached to the inner face of the bottom part of the oil pan 2 by welding and presses the oil pan separator 3 from thereunder. The oil pan separator 3 is pressed by the damping material 9 from thereunder, thus being restrained from generating vibration/noise. At the same time, the oil pan 2 is pressed downward by a reaction force, thus being restrained from generating vibration/noise. As the damping material 9, rubber materials, coil springs, and the like can be used as well.

Figure 15:
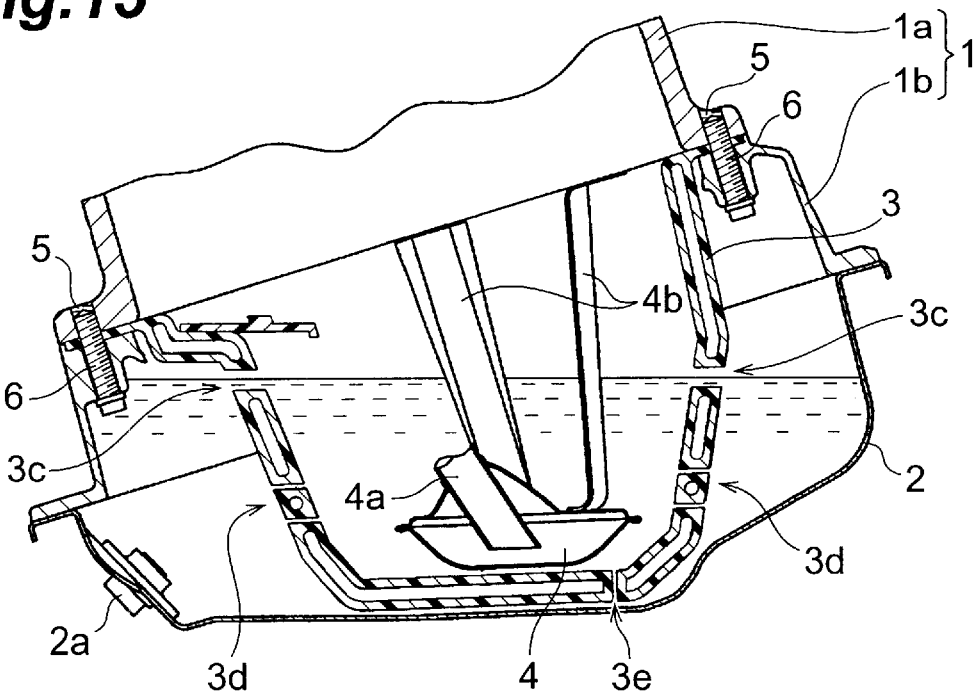
FIG. 15 is a view, similar to FIG. 4, showing a second modified example of the oil pan structure of the present invention.

In the modified example shown in FIG. 15, the oil pan separator 3 has a double-wall structure. FIG. 15 is also a view corresponding to FIG. 4 showing the first embodiment. In this embodiment, the inside of the double-wall structure made of a synthetic resin is an air layer, which further improves the heat insulating property of the oil pan separator 3. This can further restrain heat from escaping from the main chamber to the sub chamber, whereby the temperature of engine oil within the main chamber can be raised earlier. The inside of the double-wall structure may also be filled with an insulating material (solid, liquid, or gas) and the like instead of the air. Also, a lid may be provided, such that the high-temperature engine oil on the lid passes through the double-wall structure so as to be introduced into the main chamber from near the suction port of the strainer 4. This enables the engine oil at a higher temperature to circulate while improving the heat-insulating effect caused by the oil pan separator 3.

Figure 16:
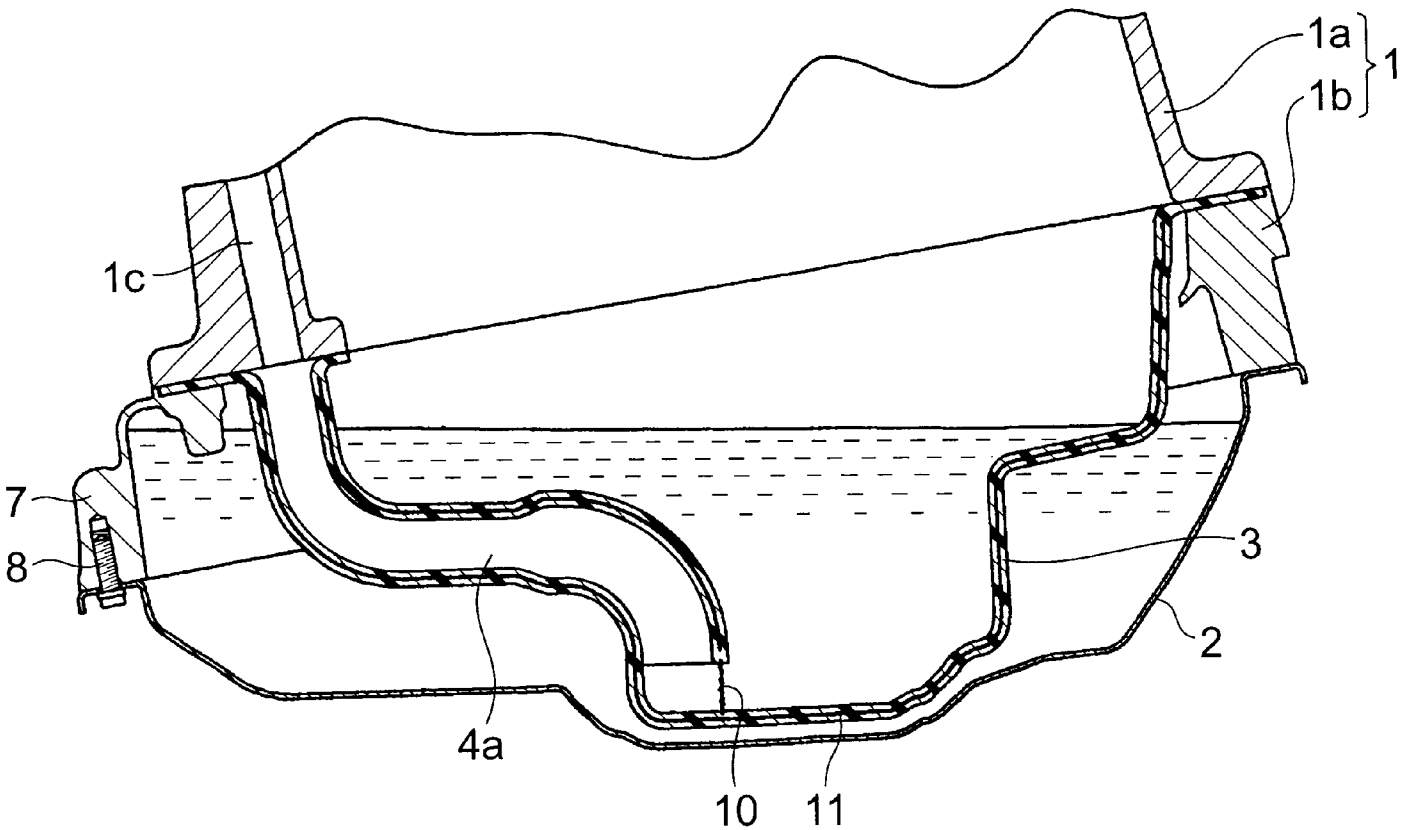
FIG. 16 is a view, similar to FIG. 5, showing a third modified example of the oil pan structure of the present invention.
Figure 17:
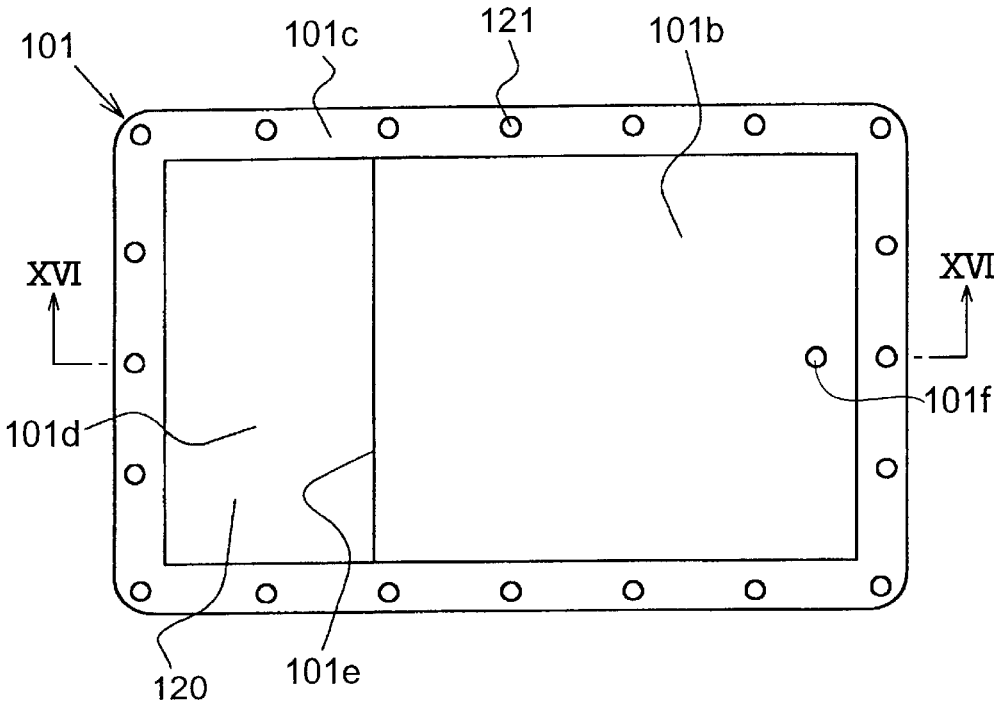
FIG. 17 is a plan view showing an oil pan separator in a second embodiment of the present invention.
Figure 18:
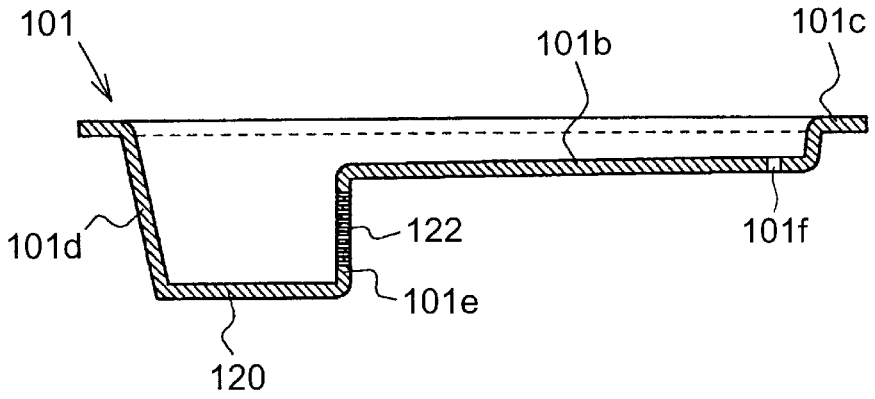
FIG. 18 is a sectional view taken along the line XVI—XVI of FIG. 17.
Figure 19:
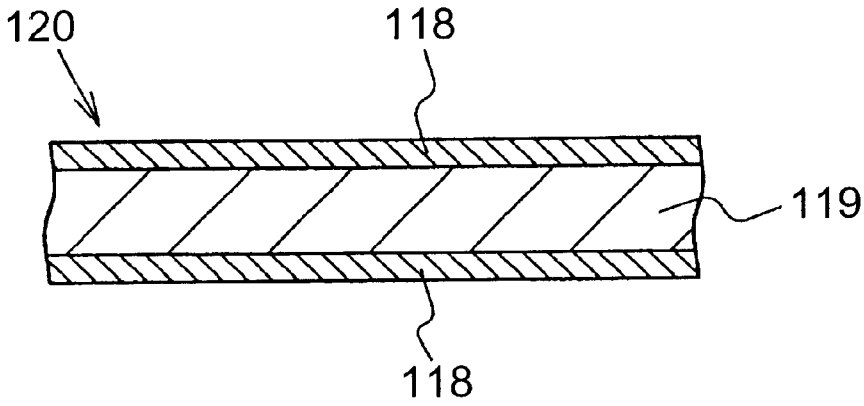
FIG. 19 is an enlarged sectional view showing a heat-insulating sheet material constituting an oil pan separator.

In the modified example shown in FIG. 16, the oil pan separator 3 made of a synthetic resin is integrally formed with an oil suction pipe 4*a*. FIG. 16 is a view corresponding to FIG. 5 showing the first embodiment. A suction port opens at an end part of the oil suction pipe 4*a*, whereas a filter 10 is disposed at this part. For forming the oil suction pipe 4*a*, a part having a semicircular section is formed on the body side of the oil pan separator 3, and one having a corresponding semicircular section is attached thereto by welding, bonding, and the like from the inside of the body of the oil pan separator 3.

In such a manner, the oil pan separator 3 can be integrally formed with the tubular oil suction pipe 4*a*. This not only can simplify the manufacturing process, but also improves the rigidity of the oil pan separator 3, thereby contributing to improvements of vibration and noise characteristics. The filter 10 is a metal net or nonwoven, and is inserted upon molding with the synthetic resin. Also, in this example, a damping material 11 is inserted into the oil pan separator 3. This enhances the rigidity of the oil pan separator 3, thereby restraining vibration/noise from occurring.

A second embodiment of the present invention will now be explained. The sub chamber exists so as to surround the whole main chamber in the above-mentioned first embodiment, but not in the second embodiment explained in the following. Nevertheless, both of them are aimed at raising the temperature of engine oil within the main chamber at an early stage. In the second embodiment, the oil pan separator is made of a metal.

In this embodiment, the oil pan separator is formed from a heat-insulating sheet material, whereas a main chamber constructing part partly forming a part of the oil pan separator constitutes the main chamber. As a consequence, the main chamber is surrounded by the heat-insulating sheet material, so that heat radiation of the main chamber is reduced, thermal efficiency is enhanced, and the rapid heating of lubrication oil in the main chamber can effectively be achieved.

Since the main chamber is not constructed between a part of the inner face of the oil pan and the oil pan separator as in conventional configurations, but is constituted by the main chamber constructing part of the oil pan separator, whereby the lubrication oil does not travel between the main and sub chambers through the gap between the separator and the periphery of the oil pan as in the conventional configurations. This not only makes it unnecessary to weld the periphery of the separator and the inner face of the oil pan to each other, but can reliably prevent the lubrication oil from traveling between the main and sub chambers through such an undesirable part. Further, it can completely suppress interference sounds between the separator and oil pan occurring from such a welded part.

Also, the oil pan separator can integrally be formed with an oil pan gasket part, which improves the workability of assembling.

Employable as an example of the heat-insulating sheet material is a metal sheet having both sides coated with a compound containing a heat-resistant nonmetal fiber other than asbestos, a filler, and an elastomer.

In this case, as a heat-resistant nonmetal fiber, an inorganic fiber or an organic fiber may be used alone, or inorganic and organic fibers may be used as a mixture. However, inorganic fibers other than asbestos are poor in softness and thus lower the damping performance when used alone, whereas organic fibers exhibit a heat resistance inferior to that of organic fibers in general, whereby the heat resistance of the oil pan separator deteriorates when the organic fibers are used alone. Therefore, it is preferred that inorganic and organic fibers be used as a mixture.

Examples of inorganic fibers employable include glass fiber, ceramic fiber, rock wool, slag wool, molten quartz fiber, chemically processed high silica fiber, molten alumina silicate fiber, alumina continuous fiber, stabilized zirconia fiber, boron nitride fiber, alkali titanate fiber, whisker, and boron fiber.

Examples of organic fibers employable include aramid fiber (aromatic polyamide fiber), polyamide type fiber, polyolefin type fiber, polyester type fiber, polyacrylonitrile type fiber, polyvinyl alcohol type fiber, polyvinyl chloride type fiber, polyurea type fiber, polyurethane type fiber, polyfluorocarbon type fiber, phenol fiber, and cellulose type fiber.

Preferably, the heat-resistance nonmetal fiber is contained in the compound by 30 to 80 wt %.

Employable as the elastomer constituting the compound are rubber materials such as nitrile rubber (NBR), styrene butadiene rubber (SBR), isoprene rubber (IR), chloroprene rubber (CR), butadiene rubber (BR), butyl rubber (IIR), ethylene-propyrene rubber (EPM), fluorine-containing rubber (FPM), silicone rubber (Si), chlorosulfonated polyethylene (CSM), ethylene vinyl acetate rubber (EVA), chlorinated polyethylene (CPE), butyl chloride rubber (CIR), epichlorohydrin rubber (ECO), and nitrile isoprene rubber (NIR), for example. Other kinds of elastomer may be used instead of rubber as well.

Though organic fillers may be used as a filler constituting the compound, heat resistance deteriorates in general when an organic filler is used. Therefore, it is preferred that inorganic fillers such as clay, talc, barium sulfate, sodium bicarbonate, graphite, lead sulfate, rottenstone, and wollastonite, for example, be used. Though a steel sheet, a stainless steel sheet, and the like are preferable as a metal sheet, for example, other kinds of metal sheets can be used as well. Also, heat-insulating sheet materials other than those in which metal sheets are coated with a compound can be used in the present invention.

FIGS. 17 to 21 show the oil pan separator 101 in this embodiment. This oil pan separator 101 as a whole is formed by pressing a heat-insulating sheet material 120 (see FIG. 19) in which each of both sides of a steel sheet 119 (SPCC with a sheet thickness of 0.6 mm) precoated with a heat-resistant adhesive is coated with a compound having the following composition by a thickness of 200 $\mu$m.

| Composition of Compound 118 | |
|---|---|
| Glass fiber | 30 wt % |
| Fibrillated aromatic polyamide fiber (product name: Kevlar pulp manufactured by DuPont) | 10 wt % |
| Nitrile rubber (NBR) | 16 wt % |
| Rubber chemical | 4 wt % |
| Inorganic filler | 40 wt % |

In the composition of the compound 118, glass fiber is a kind of inorganic fiber, whereas fibrillated aromatic polyamide fiber is a kind of organic fiber, each being a heat-resistant nonmetal fiber.

Examples of the rubber chemical in the composition of the compound 118 include vulcanizing agents such as sulfur, zinc oxide, magnesium oxide, peroxide, and dinitrobenzene; and vulcanization accelerators such as thiazole type compounds, polyamine type compounds, sulfenamide type is compounds, dithiocarbamate type compounds, aldehyde-amine type compounds, guanidine type compounds, thio-urea type compounds, and xanthate type compounds.

The oil pan separator 101 integrally comprises an oil pan gasket part 101*c*, a main chamber constructing part (recess) 101*d*, and an upper face part 101*b*. The oil pan gasket part 101*c* has a flange form constituting the whole periphery of the oil pan separator 101, and is provided with bolt holes 121. The main chamber constructing part 101*d* is provided on one end side of the oil pan separator 101, and is depressed into a large recess opening upward so as to be able to store a lubrication oil.

Figure 20A:
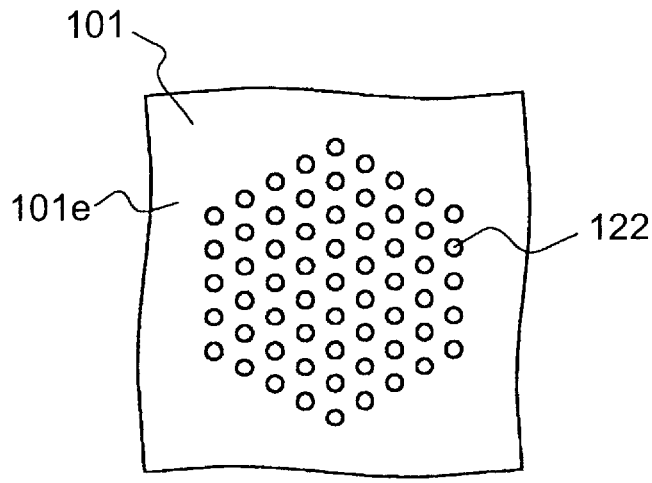
FIG. 20A is an enlarged front view showing a first example of hole part communicating main and sub chambers to each other.
Figure 20B:
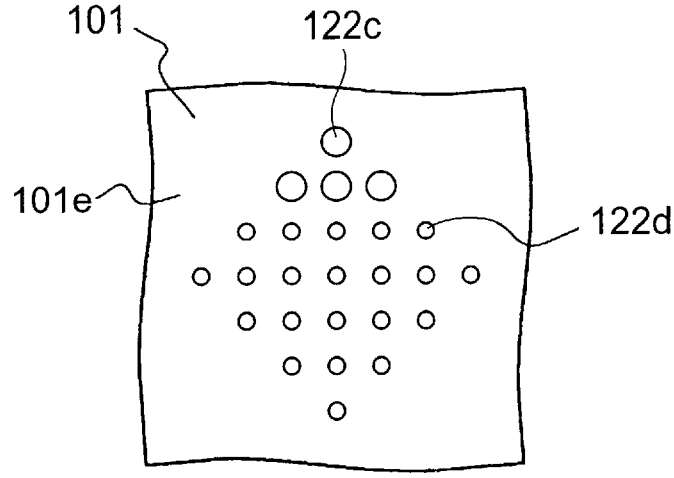
FIG. 20B is an enlarged front view showing a second example of hole part communicating main and sub chambers to each other.
Figure 20C:
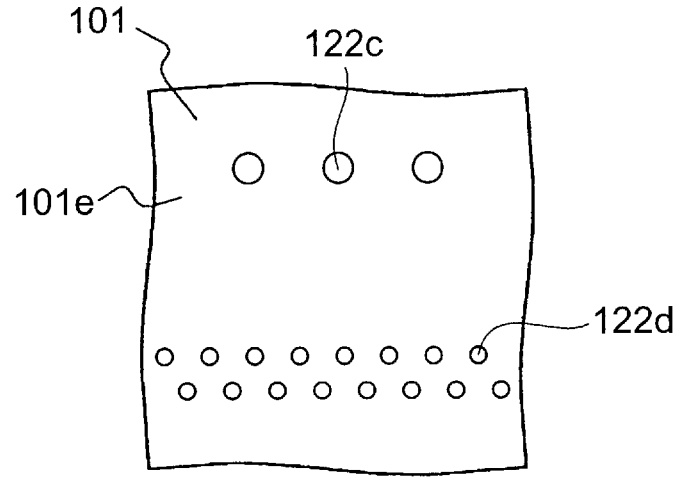
FIG. 20C is an enlarged front view showing a third example of hole part communicating main and sub chambers to each other.

At a relatively high position (which becomes a shallow position within the oil pan 102 when accommodated therein as will be explained later), the upper face part 101*b* extends from the other end side of the oil pan separator 101 to the upper end of the main chamber constructing part 101*d* and tilts slightly downward toward the main chamber constructing part 101*d*. The part 101*e* (which becomes a portion separating a main chamber 108 and a sub chamber 109 from each other when accommodated in the oil pan 102 as will be explained later) located under the boundary between the main chamber constructing part 101*d* and the upper face part 101*b* in the portion forming the wall of the main chamber constructing part 101*d* is formed with numerous small holes (communication holes) 122 each having a diameter of about 1 to 2 $\mu$m. FIGS. 20A to 20C show enlarged views of the small holes 122. If all of them are formed as small holes (communication holes) each having a diameter of about 1 mm, they may be clogged when used for a long period of time. Therefore, it is preferred that all of them be formed as small holes 122 each having a diameter of about 2 mm as shown in FIG. 20A, or those each having a diameter of about 1 mm and those each having a diameter of about 2 mm be dispersed in a mixed state. Alternatively, as shown in FIGS. 20B and 20C, large holes 122*c* each having a diameter of about 3 mm may be disposed on the upper side of small holes 122*d* each having a diameter of about 2 mm.

Figure 21:
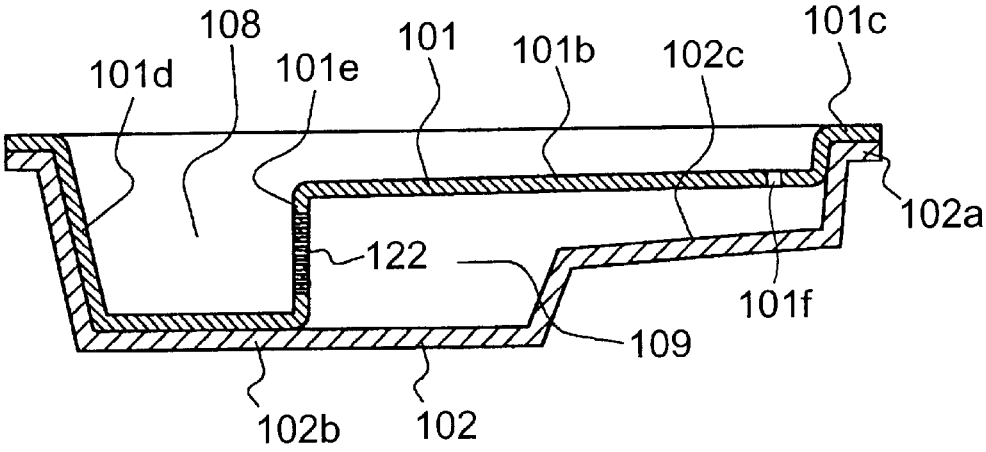
FIG. 21 is a sectional view showing a state where an oil pan separator is accommodated in an oil pan.

FIG. 21 shows a state where the oil pan separator 101 is accommodated in the oil pan 102. As the oil pan 102, conventional ones can be used. It has a deep bottom part 102*b* on one end side and a shallow bottom part 102*c* on the other end side. As shown in FIG. 21, the oil pan separator 101 is attached to a cylinder block of an internal combustion engine (not depicted) in a state where the main chamber constructing part 101*d* and the upper face part 101*b* are accommodated in the oil pan 102 whereas the oil pan gasket part 101*c* is superposed on the upper face of the flange 102*a* of the oil pan 102. As a consequence, the oil pan gasket part 101*c* is interposed between the cylinder block and the oil pan 102 and seals them. The main chamber constructing part 101*d* and the upper face part 101*b* are accommodated on the deep bottom part 102*b* side and the shallow bottom part 102*c* side, respectively.

In the state accommodated in the oil pan 102 as such, the space within the main chamber constructing part 101*d* of the oil pan separator 101 constitutes the main chamber 108. Consequently, as far as the main chamber 108 is concerned, the oil pan 102 does not directly come into contact with the lubrication oil, but only contributes to structural strength on the outside of the oil pan separator 101, thus failing to function to store the oil. In the portion forming the wall of the main chamber constructing part 101*d*, the part 101*e* positioned below the boundary between the main constructing part 101*d* and the upper face part 101*b* separates the main chamber 108 and the sub chamber 109 from each other, whereby the main chamber 108 and the sub chamber 109 are communicated to each other only through the small holes 122 formed in the part 101*e*. A suction port of a strainer (not depicted) is disposed within the main chamber 108.

The heat-insulating sheet material 120 has a quite favorable heat-insulating property, since it is coated with the compound 118. Since the main chamber 108 is constituted by the main chamber constructing part 101*d* of the oil pan separator 101, the main chamber 102 is surrounded by the heat-insulating sheet material 120, so that the heat radiation of the main chamber 108 is reduced, which enhances thermal efficiency, whereby the rapid heating in the main chamber 108 can effectively be achieved.

Also, since the main chamber 108 is constituted by the main chamber constructing part 101*d* of the oil pan separator 101, no lubrication oil travels between the main chamber 108 and the sub chamber 109 by way of the gap between the separator 101 and the oil pan 102, which makes it unnecessary to weld the separator 101 and the inner face of the oil pan 102 to each other, whereas the lubrication oil can reliably be prevented from traveling between the main chamber 108 and the sub chamber 109 by way of undesirable parts, i.e., parts other than the small holes 122, and interference sounds can completely be kept from occurring between the separator 101 and the oil pan 102.

Since the oil pan separator 101 is integrally formed with the oil pan gasket part 101*c*, the workability of assembling improves. Also, since the heat-insulating sheet material 120 is coated with the compound 118, the oil pan gasket part 101*c* exhibits a very fine gasket characteristic.

When the oil moves from the sub chamber 109 to the main chamber 108, the small holes 122 can remove dusts from within the oil.

Figure 22A:
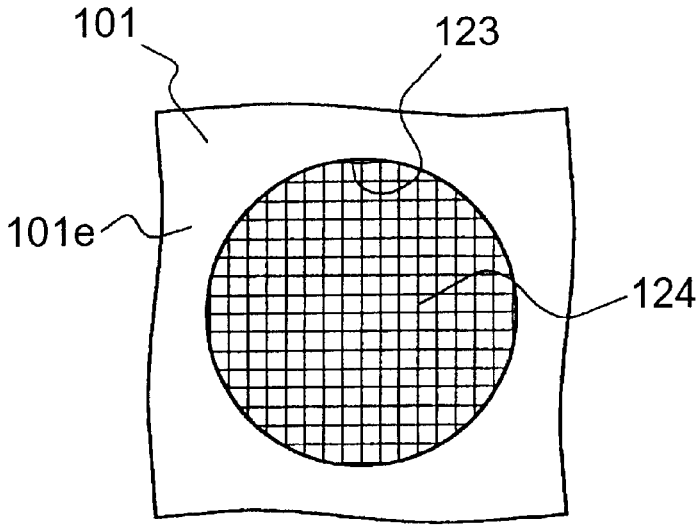
FIG. 22A is an enlarged front view showing a fourth example of hole part communicating main and sub chambers to each other.
Figure 22B:
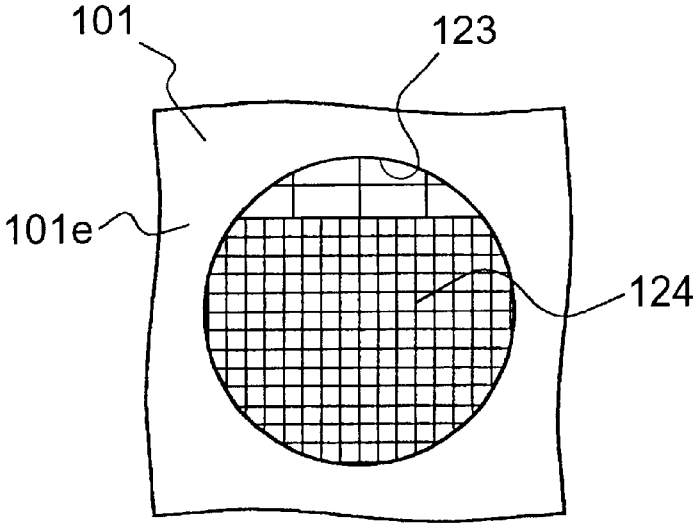
FIG. 22B is an enlarged front view showing a fifth example of hole part communicating main and sub chambers to each other.

FIGS. 22A and 22B show other examples of the part communicating the main chamber 108 and the sub chamber 109 to each other. In FIG. 22A, an opening 123 is formed at the part corresponding to the area formed with the small holes 122 in FIG. 20A mentioned above, whereas a net (metal net) 124 made of stainless steel is attached to the opening 123. Preferably, the net 124 is one having 30 to 200 meshes (corresponding to a diameter of 0.1 to 0.3 mm). As shown in FIG. 22B, a major part of the net 124 may be made of meshes each corresponding to a hole having a diameter of 2 mm whereas only apart positioned on the upper side maybe made of meshes each corresponding to a hole having a diameter of 8 mm.

When the net 124 is provided as in this example, finer dusts can also be removed from the oil moving from the sub chamber 109 to the main chamber 108. Instead of the net 124, a nonwoven may be attached to the opening 123 as well. This embodiment can reduce the heat radiation of the main chamber, whereby the rapid heating of lubrication oil in the main chamber can effectively be achieved. Also, this embodiment requires no welding operation for the oil pan, can securely prevent the lubrication oil from traveling between the main and sub chambers through undesirable parts, and can completely prevent interference sounds from occurring with respect to the oil pan. Further, this embodiment can integrally form the oil pan separator with the oil pan gasket, thereby improving the workability of assembling. Furthermore, this embodiment can remove fine dusts from within the lubrication oil.

Namely, this embodiment can achieve excellent effects, for example, in that:

(A) the heat radiation of the main chamber is reduced, whereby the rapid heating of lubrication oil in the main chamber can effectively be achieved;

(B) no welding between the periphery of the oil pan separator and the inner face of the oil pan is necessary, the lubrication oil can securely be prevented from traveling between the main and sub chambers through undesirable parts, and interference sounds can completely be prevented from occurring between the oil pan separator and the oil pan;

(C) the oil pan separator can integrally be formed with the oil pan gasket part, whereby the workability of assembling can be improved; and (D) if a part separating the main and sub chambers from each other in a portion forming the wall of the main chamber constructing part is provided with an opening whereas a net or nonwoven is attached to the opening, finer dusts can be removed from within the oil moving from the sub-chamber to the main chamber.

Figure 23:
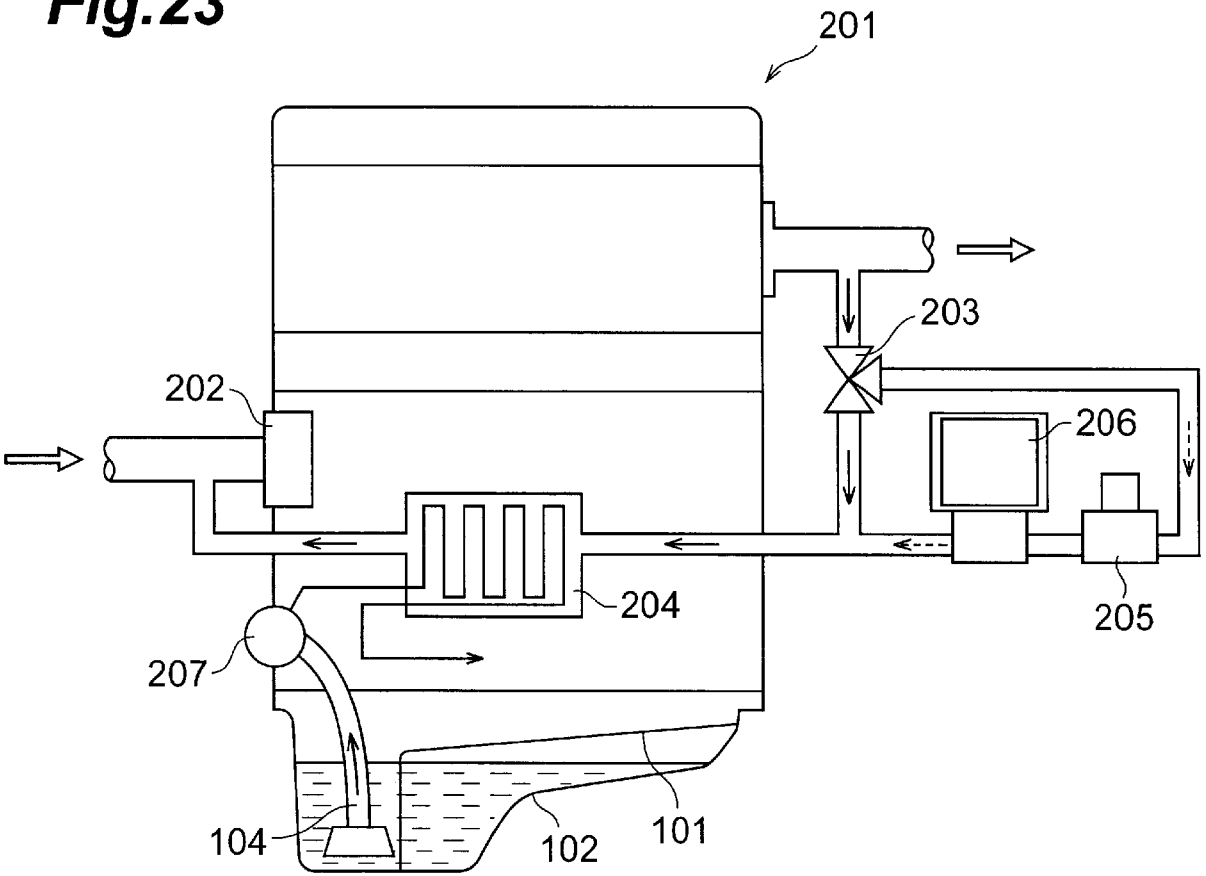
FIG. 23 is an engine diagram (first example) provided with a heat exchanger using cooling water.

A system adapted to warm up the engine oil more effectively upon a cold start by using the above-mentioned oil pan structure therewith will now be explained. FIG. 23 is a diagram showing this system. The engine 201 shown in FIG. 23 has the oil pan 102 shown in FIG. 21.

Cooling water fed by way of a radiator is supplied to the engine 201 from the left side of the drawing by an oil pump 202. The cooling water having received heat from the engine 201 is discharged therefrom rightward in the drawing. A branched pipe is attached to the cooling water discharge path from the engine 201. A three-way valve 203 is attached to the branched pipe. One of the two remaining ends of the three-way valve 203 is directly connected to a heat exchanger 204, whereas the other is connected to the heat exchanger 204 by way of an electric pump 205 and a heat storage tank 206.

The heat exchanger 204 carries out heat exchange between the cooling water and the engine oil. The engine oil is sent from the main chamber within the oil pan 102 to the heat exchanger 204 by an oil pump 207 by way of the strainer 104. Here, the temperature of engine oil is raised by utilizing the temperature of cooling water. The engine oil heated in the heat exchanger 204 is circulated through individual parts of the engine 201. In general, the temperature of cooling water rises faster than that of engine oil upon a cold start. Therefore, cooling water is used for raising the temperature of engine oil at an early stage upon the cold start here.

Namely, immediately after the cold start, the three-way valve 203 is switched over such that the cooling water warmed by the engine 201 flows to the electric pump 205 and the heat storage tank 206 here. The heat storage tank 206 stores the heat of cooling water in the previous operation of the engine 201. As a consequence, the cooling water sent to the heat exchanger 204 by the electric pump 205 immediately after the cold start is heated by the body of engine 201 at an early stage, receives heat from the heat storage tank 206, so as to raise its temperature further, and then reaches the heat exchanger 204.

In the heat exchanger 204, the engine oil not sufficiently heated immediately after the cold start is heated by the cooling water at an early stage. As mentioned above, the oil pan 102 has a structure having the oil pan separator 101. As a consequence, due to a synergetic effect between the above-mentioned effect of the oil pan structure and the effect caused by the heat exchanger 204, the temperature of engine oil can be raised earlier. When the temperature of cooling water has become high enough, the heat is stored in the heat storage tank 206, and then the three-way valve 203 is switched so that the cooling water fed from the engine 201 is directly sent to the heat exchanger 204.

The heat storage tank 206 can store heat for a longer period of time. For example, the heat stored in the heat storage tank 206 upon driving to an office in the morning can effectively be used for driving from the office in the evening. On the other hand, the heat stored in the heat storage tank 206 upon driving home in the evening can effectively be utilized for driving to the office in the next morning. Providing the heat storage tank 206 as such can effectively reuse the heat that will be wasted otherwise.

The above-mentioned example is one in which the cooling water after warm-up is stored in the heat storage tank 206, and the warm cooling water within the heat storage tank 206 warms the engine oil immediately after the cold start. However, the engine oil after the warm-up may be stored in the heat storage tank, and the warm engine oil within the heat storage tank may be supplied into the main chamber of the oil pan having a double structure immediately after the cold start. This can achieve similar effects as well.

Figure 24:
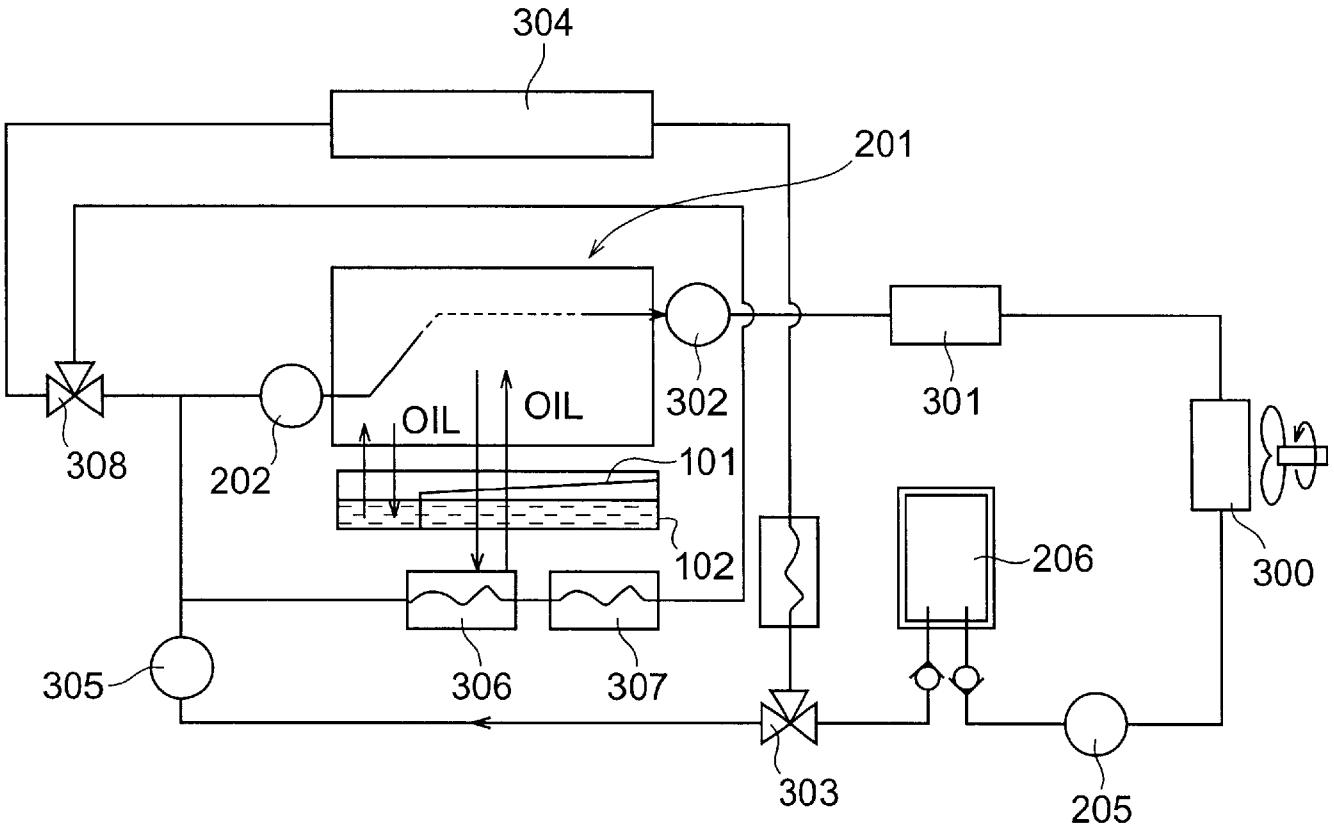
FIG. 24 is an engine diagram (second example) provided with a heat exchanger using cooling water.

FIG. 24 shows another example of early temperature rising of the engine using cooling water. This engine 201 is identical to that of FIG. 23 mentioned above, whereby parts identical or equivalent to each other will be referred to with numerals identical to each other while omitting their detailed explanations. The system shown in FIG. 24 is characterized in that an MPH (multipurpose heater) 301 is provided for completing the warm-up of the engine 201 at an early stage. The MPH 301 receives and burns a part of a fuel of the engine 201, and forcibly raises the temperature of cooling water with thus generated heat. The burning in the MPH 301 is under control.

Namely, the temperature of cooling water discharged from the engine 201 is measured by a temperature sensor 302. If the temperature is at a predetermined value or lower, the fuel is burned by the MPH 301, whereby the temperature of cooling water is raised. The cooling water heated by the MPH 301 travels by way of a heater 300 for heating the interior of the car (whereby the in-car heating is available earlier), an electric pump 205, and a heat storage tank 206, whereby its subsequent destination is switched by a three-way valve 303. At the time immediately after the cold start and the like, the temperature of cooling water is desired to be raised as earlier as possible, whereby the cooling water is not cooled by a radiator 304. In this case, the cooling water is sent by the three-way valve 303 to the upstream side of the engine 201 by way of a temperature sensor 305. According to results of detection effected by these temperature sensors 302, 305, the MPH 301 is controlled.

Here, the water path is branched on the downstream side of the temperature sensor 305, so as to form a flow path connected to the upstream side of the engine 201 by way of an oil cooler (heat exchanger) 306 and an EGR cooler 307. Since the oil cooler 306 is a heat exchanger, the temperature of engine oil can also be raised by the heat of cooling water whose temperature is raised by the MPH 301 immediately after a cold start. When the temperature of engine oil is too high, it may be lowered by the cooling water. The EGR cooler cools an EGR gas (and can heat the latter as well since it is a heat exchanger).

The flow rate of cooling water through this flow path is regulated by a three-way valve 308 which can adjust the flow rate under electronic control. This can regulate the flow rate directly refluxed to the upstream side after passing the temperature sensor 305 while bypassing the radiator 304, and the flow rate refluxed by way of the oil cooler 306. Here, the switching of flow paths via the radiator 304 is also effected by the three-way valve 308. The burning in the MPH 301 is stopped when it becomes unnecessary. Such a configuration can raise the temperature of engine oil earlier due to a synergetic effect between the above-mentioned effect of the oil pan structure and the effect of early temperature rising caused by the cooling water.

Figure 25:
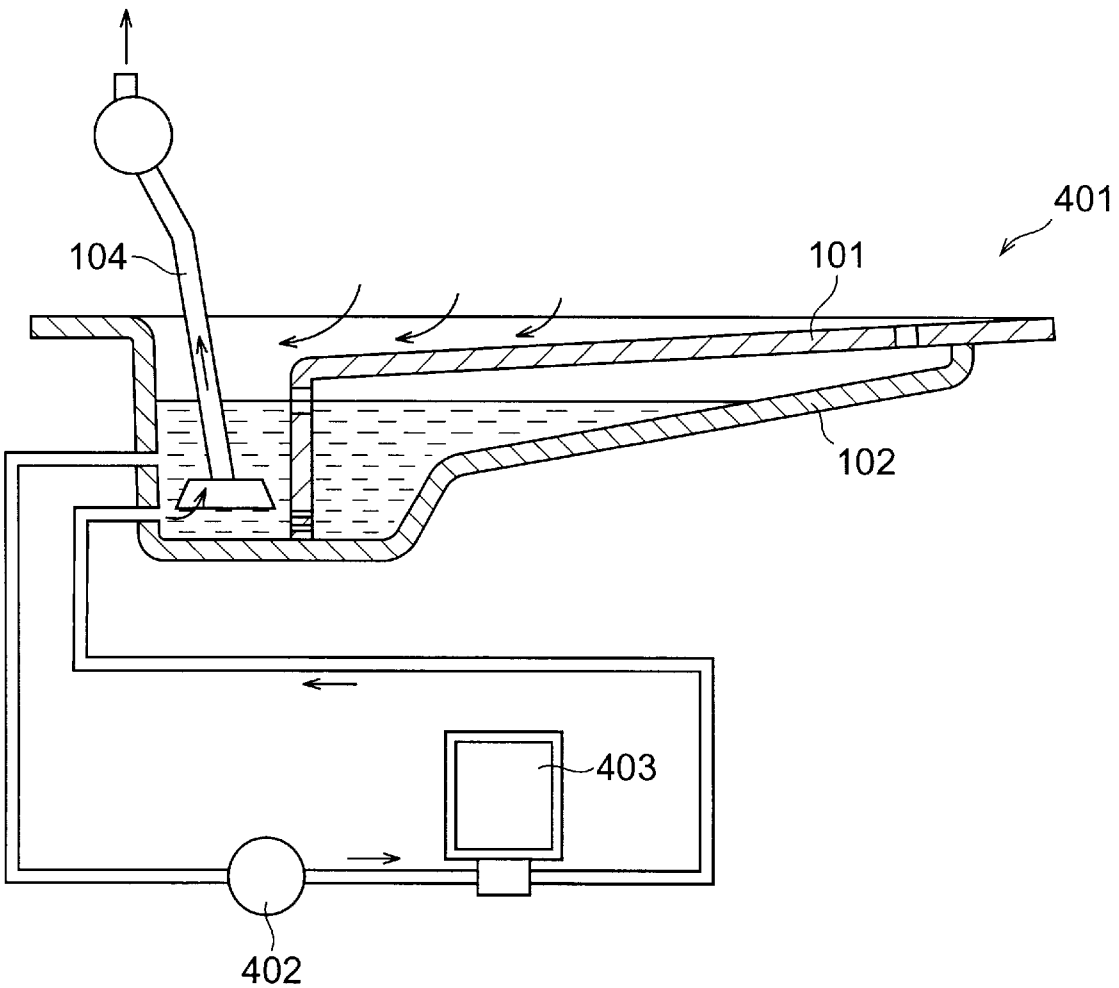
FIG. 25 is an engine diagram utilizing a heat storage tank.

FIG. 25 shows a system for directly raising the temperature of engine oil by utilizing the above-mentioned heat storage tank. The engine 401 shown in FIG. 25 is provided with a pipe through which the engine oil is sent from the main chamber by an electric pump 402 so as to be refluxed to the main chamber by way of a heat storage tank 403. Effectively utilizing the heat in the previous operation by using the storage tank 403 can further promote the early temperature rising of the engine oil within the main chamber. The system for raising the temperature of engine oil earlier by using cooling water is not limited to those of embodiments mentioned above. For example, it can also be employed as a so-called vapor cooling system in which a rotary valve is provided in place of a thermostat valve so as to pressurize the cooling water in a water jacket and raise the boiling point of cooling water.

The oil pan structure (oil pan separator) of the present invention is not limited to those of the above-mentioned embodiments. For example, while the oil pan structure (oil pan separator) of the present invention is employed as an oil pan structure (oil pan separator) for the engine in the above-mentioned embodiments, it is also employable for an oil pan of an electromagnetically driven valve in which in which an intake/exhaust valve is directly driven by a solenoid, and an oil pan of an automatic transmission.

The oil pan 2 and oil pan separator 3 having a foamed resin layer employed in the oil pan structure of the first embodiment can also be used in combination with other embodiments.

From the invention thus described, it will be obvious that the embodiments of the invention may be varied in many ways. Such variations are not to be regarded as a departure from the spirit and scope of the invention, and all such modifications as would be obvious to one skilled in the art are intended for inclusion within the scope of the following claims.

What is claimed is:

1. An oil pan structure comprising an oil pan separator, disposed within an oil pan, for separating a main chamber provided with a suction port disposed therewithin and a sub chamber provided with no suction port from each other, said oil pan separator having a recess forming said main chamber, said main chamber communicating with the inside of an engine block, said recess being formed with a communication hole for communicating said main and sub chambers to each other.

2. An oil pan structure according to claim 1, wherein said sub chamber is formed so as to surround said main chamber as a whole, an outer face of a bottom part of said oil pan separator and an inner face of a bottom part of said oil pan being kept from coming into contact with each other.

3. An oil pan structure according to claim 2, further comprising a damping material disposed between the bottom part of said oil pan separator and said oil pan.

4. An oil pan structure according to claim 1, wherein said oil pan separator has an outer periphery secured by being held between divided pieces of said engine block or between said engine block and said oil pan.

5. An oil pan structure according to claim 1, wherein said oil pan has a foamed resin layer, disposed on an inner surface thereof, having a higher density on a surface coming into contact with an oil and a lower density on the inside thereof.

6. An oil pan structure according to claim 1, wherein said oil pan separator is formed from a synthetic resin.

7. An oil pan structure according to claim 1, wherein said oil pan separator is formed from a foamed resin layer having a higher density on each surface coming into contact with an oil, and a lower density on the inside thereof.

8. An oil pan structure according to claim 6, wherein said oil pan separator is integrally formed with an oil suction pipe having said suction port opening at an end part thereof.

9. An oil pan structure according to claim 1, wherein said recess of said oil pan separator has a double-wall structure.

10. An oil pan structure according to claim 1, further comprising a lid provided on the upper side of said main chamber, an opening for introducing an engine oil into said main chamber being formed in said lid at a center thereof, said lid tilting downward in an outward direction from said opening.

11. An oil pan structure according to claim 2, wherein at least one first communication hole is formed on the upper side of a side wall of said main chamber, whereas at least one second communication hole is formed on the lower side of the side wall of said main chamber;

each said first communication hole having an opening area larger than that of each said second communication hole, said first and second communication holes being formed at respective positions substantially opposing each other with respect to a center of said main chamber.

12. An oil pan structure according to claim 1, wherein said communication hole is a burring hole.

13. An oil pan structure according to claim 1, wherein said communication hole is a louver hole.

14. An oil pan structure according to claim 1, further comprising a heat exchanger for exchanging heat between engine cooling water and an engine oil, a heat storage tank for storing said engine cooling water after warming up, and heat-accumulated water supplying means for supplying said heat exchanger with said engine cooling water stored in said heat storage tank immediately after a cold start.

15. An oil pan structure according to claim 1, further comprising a heat storage tank for storing an engine oil after warming up, and heat-accumulated oil supplying means for supplying said main chamber with said engine oil stored in said heat storage tank immediately after a cold start.

16. An oil pan separator, disposed in an oil pan of an internal combustion engine, for separating a space within said oil pan into a main chamber provided with a suction part of an oil pump and a sub chamber provided with no suction part;

said oil pan separator having a main chamber constructing part formed from a heat-insulating sheet material and recessed so as to be able to store a lubrication oil, wherein, when said main chamber constructing part is accommodated in said oil pan, a space within said main chamber constructing part constitutes said main chamber, whereas a portion of the part constituting a wall of said main chamber constructing part separates said main and sub chambers from each other.

17. An oil pan separator according to claim 16, wherein said oil pan separator is integrally formed with an oil pan gasket part interposed between a cylinder block of said internal combustion engine and said oil pan.

18. An oil pan separator according to claim 16, wherein said heat-insulating sheet material comprises a metal sheet having both sides coated with a compound containing a heat-resistant nonmetal fiber other than asbestos, a filler, and an elastomer.

19. An oil pan separator according to claim 16, wherein a portion separating said main and sub chambers from each other in the part constituting the wall of said main chamber constructing part is formed with an opening communicating said main and sub chambers to each other, whereas a nonwoven or net adapted to filter a lubrication oil therethrough is attached to said opening.

* * * * *